US007591525B2

(12) United States Patent
Arazaki

(10) Patent No.: US 7,591,525 B2
(45) Date of Patent: Sep. 22, 2009

(54) PRINTING APPARATUS, PRINTING PROGRAM, PRINTING METHOD, PRINTING CONTROL DEVICE, PRINTING CONTROL PROGRAM, PRINTING CONTROL METHOD, AND RECORDING MEDIUM RECORDED WITH PROGRAM

(75) Inventor: Shinichi Arazaki, Suwa (JP)

(73) Assignee: Seiko Epson Corporation (JP)

( * ) Notice: Subject to any disclaimer, the term of this patent is extended or adjusted under 35 U.S.C. 154(b) by 113 days.

(21) Appl. No.: 11/461,532

(22) Filed: Aug. 1, 2006

(65) Prior Publication Data

US 2007/0024662 A1 Feb. 1, 2007

(30) Foreign Application Priority Data

Aug. 1, 2005 (JP) ..... 2005-222526
Jun. 8, 2006 (JP) ..... 2006-159623

(51) Int. Cl.
*B41J 29/393* (2006.01)

(52) U.S. Cl. ..... 347/19; 347/15

(58) Field of Classification Search ..... None
See application file for complete search history.

(56) References Cited

U.S. PATENT DOCUMENTS 6,283,571 B1 9/2001 Zhou et al.
6,293,643 B1 9/2001 Shimada et al.
6,328,404 B1 12/2001 Fujimori
2004/0201818 A1* 10/2004 Yamamoto et al. ..... 349/187

FOREIGN PATENT DOCUMENTS

| | | |
|---|---|---|
| EP | 1332882 A1 * | 8/2003 |
| JP | 01-235655 | 9/1989 |
| JP | 11-151821 | 6/1999 |
| JP | 11-254662 | 9/1999 |
| JP | 2000-79710 | 3/2000 |
| JP | 2000-190470 | 7/2000 |
| JP | 2000-225716 | 8/2000 |
| JP | 2002-19101 | 1/2002 |
| JP | 2003-63043 | 3/2003 |
| JP | 2003-136702 | 5/2003 |

* cited by examiner

*Primary Examiner*—Matthew Luu
*Assistant Examiner*—Justin Seo
(74) *Attorney, Agent, or Firm*—Harness, Dickey & Pierce, P.L.C.

(57) ABSTRACT

A printing apparatus includes a printing head that has a plurality of nozzle modules corresponding to various ink colors arranged in parallel, an abnormal nozzle specifying unit that specifies an abnormal nozzle that is deviated from an ideal dot printing position by a predetermined distance or more among nozzles constituting each of the nozzle modules of the printing head, and a density correction unit that corrects a density of a dot printing line to be printed by the nozzles including the abnormal nozzle specified by the abnormal nozzle specifying unit and printing the same line as the abnormal nozzle. The density correction unit corrects printing data corresponding to the dot printing line printed by the nozzles including the abnormal nozzle and printing the same line as the abnormal nozzle so as to be close to densities of other dot printing lines to be printed by only normal nozzles.

1 Claim, 24 Drawing Sheets

300

| DOT SIZE (DOT DIAMETER) | GRAY-SCALE VALUE | DENSITY (LUMINANCE) | PIXEL VALUE | THRESHOLD VALUE |
|---|---|---|---|---|
| NO DOT | 1 | (0) 255 | 0～42 | |
| ● (SMALL) | 2 | (85) 170 | 43～126 | ← 42 (FIRST THRESHOLD VALUE) |
| ● (MEDIUM) | 3 | (170) 85 | 127～210 | ← 126 (SECOND THRESHOLD VALUE) |
| ● (LARGE) | 4 | (255) 0 | 211～255 | ← 210 (THIRD THRESHOLD VALUE) |

FIG. 5

LOW DENSITY
(HIGH LUMINANCE)
REGION

HIGH DENSITY
(LOW LUMINANCE)
REGION

PRINTING APPARATUS, PRINTING PROGRAM, PRINTING METHOD, PRINTING CONTROL DEVICE, PRINTING CONTROL PROGRAM, PRINTING CONTROL METHOD, AND RECORDING MEDIUM RECORDED WITH PROGRAM

RELATED APPLICATIONS

This application claims priority to Japanese Patent Application Nos. 2005-222526 filed Aug. 1, 2005 and 2006-159623 filed Jun. 8, 2006 which are hereby expressly incorporated by reference herein in their entirety.

BACKGROUND

1. Technical Field

The present invention relates to a printing apparatus used in a facsimile machine, a copy machine, a printing apparatus for an OA instrument, or the like, to a printing apparatus control program, and to a printing apparatus control method. In particular, the present invention relates to a printing apparatus that is suitable for performing so-called ink jet printing by ejecting fine particles of liquid ink of a plurality of colors on a printing paper (that is, a recording medium) and rendering a predetermined character or image, to a printing program, to a printing method, and to a recording medium having recorded thereon the program.

2. Related Art

Hereinafter, an ink jet printing apparatus (for example, a printer) will be described as an example.

A printer that uses an ink jet system (hereinafter, referred to as an 'ink jet printer') is configured such that a moving body called a carriage having an ink cartridge and a printing head integrally formed therein reciprocates on a printing paper in a direction orthogonal to a paper feed direction (a widthwise direction of the printing paper) and ejects (jets) particles of liquid ink in dot shapes from nozzles of the printing head. Then, a predetermined character or image is rendered on the printing paper, and a printed matter desired is created. Further, ink cartridges of four colors (black, yellow, magenta, and cyan) including black and printing heads for the respective colors are provided in the carriage. Therefore, in addition to monochrome printing, full color printing is easily performed by combining the colors (in addition, color printing of six, seven, or eight colors including the above four colors, light cyan, light magenta, and the like is put into practice).

Further, in the ink jet printer that allows the printing head on the carriage to reciprocate in the direction orthogonal to the paper feed direction (that is, the widthwise direction of the printing paper) for printing, it is necessary to cause the printing head to reciprocate several tens times to one hundred times or more for vivid printing of one page. Accordingly, it takes much time for printing compared to other printing apparatuses, for example, a laser printer using an electrophotography technique, such as a copy machine. Meanwhile, such an ink jet printer is generally referred to as 'multi-pass printer' or 'serial printer'.

In the ink jet printer which has a printing head having the same length as a printing paper width and does not use a carriage, single-pass printing can be performed, without moving the printing head in the widthwise direction of the printing paper, such that fast printing can be performed like the laser printer. Further, the carriage on which the printing head is mounted or a driving system for moving the carriage is not required, such that a printer case can be made small and light-weight. In addition, silence can be significantly enhanced. Such an ink jet printer is generally referred to as 'line head printer'.

However, the printing head that is an essential part for the ink jet printer is configured such that fine nozzles each having a diameter of 10 μm to 70 μm are arranged in serial by predetermined intervals or arranged in a multi-stage manner in a printing direction, and thus ink ejection directions of some nozzles may be inclined or nozzle positions may be deviated from ideal positions due to a manufacturing error. Accordingly, dots to be formed by the nozzles are deviated from target points, which results in so-called 'flying curve phenomenon'.

As a result, defective printing occurs on a portion corresponding to the defective nozzle, which is called 'banding (band) phenomenon', thereby significantly degrading printing quality.

In particular, such a banding phenomenon may more frequently occur in the line head printer, in which the printing head is fixed (single-pass printing) and the number of nozzles is much greater than the number of nozzles of the multi-pass printer, than in the multi-pass printer described above (in the multi-pass printer, there is known a technique for causing the printing head to reciprocate several times so as to make a white band almost unnoticeable).

Accordingly, in order to prevent a kind of defective printing due to the banding phenomenon, the research and development on the hardware configuration, such as the enhancement of a printing head manufacturing technique or design improvement has been made carefully, however, it is not easy to provide a printing head which does not cause 'banding phenomenon' at all in view of a manufacture cost, printing quality, a technique, and the like.

As a result, a technique for reducing the banding phenomenon using a so-called software method, such as a printing control described below, is used in combination with the hardware improvement described above at the present time.

For example, in JP-A-2002-19101 or JP-A-2003-136702, in order to cope with a nozzle variation or non-ejected ink, a shading correction technique is used for a portion having a low density to cope with a head variation and other colors are used for a portion having a high density to make the banding or variation unnoticeable.

As for a solid image, JP-A-2003-63043 discloses a method that increases ejection amounts of the nozzles adjacent to pixels near a non-ejected nozzle so as to generate a solid image in the entire nozzles.

When a deviation in printing position of the dot is in a direction orthogonal to a nozzle arrangement direction, that is, a printing direction (paper feed direction) due to a flying curve phenomenon, such a banding phenomenon is not problematic in a case where a monochrome image is formed with one color ink. However, in case of a color image where dots of several colors are combined, a density of that portion may become darker than other portions, and color irregularity may occur.

Accordingly, a method of preparing a color conversion table per nozzle column in a printing direction and performing color matching to remove the banding phenomenon caused by the deviation in printing position in a printing direction is taken into account. However, this method requires a color conversion table per an amount of the deviation in printing position of the nozzle, and should consider the deviation in the printing position by four causes when ink of four colors of CMYK are used for printing. Accordingly, a capacity of the color conversion table to be prepared may expand.

In addition, a very large color conversion table is required when each color data of RGB and CMYK is held by 8-bit (256 gray-scale values) data. For this reason, a memory (a storage device) or a device of processing a high-performance information operation (CPU or the like) is required, thereby causing a considerable increase in manufacturing costs.

SUMMARY

An advantage of some aspects of the invention is that it provides a printing apparatus that can easily remove a banding phenomenon due to a deviation in printing position occurring particularly in a printing direction or make the phenomenon almost unnoticeable, a printing program, a printing method, a printing control device, a printing control program, a printing control method, and a recording medium having recorded thereon the program.

First Aspect

According to a first aspect of the invention, a printing apparatus includes a printing head that has a plurality of nozzle modules corresponding to various ink colors arranged, an abnormal nozzle specifying unit that specifies an abnormal nozzle that is deviated from an ideal dot printing position by a predetermined distance or more among nozzles constituting each of the nozzle modules of the printing head, and a density correction unit that corrects a density of a dot printing line to be printed by the nozzles including the abnormal nozzle specified by the abnormal nozzle specifying unit and printing the same line as the abnormal nozzle. The density correction unit corrects printing data corresponding to the dot printing line to be printed by the nozzles including the abnormal nozzle and printing the same line as the abnormal nozzle so as to be close to densities of other dot printing lines to be printed by only normal nozzles.

That is, a line where dots are formed (that is, a dot printing line) by an abnormal nozzle that is deviated from the ideal dot printing position by the predetermined distance or more (a nozzle that is deviated from a dot printing position by the predetermined distance or less is referred to a normal nozzle), has not only a different density component but also a different color component from the desired normal state, thereby causing the banding phenomenon. However, according to the first aspect of the invention, since a visual characteristic of a human being is used who is very sensitive to a change in density component but cannot sufficiently perceive a change in color component, the correction is performed on only the change in density component, not the change in color component.

Accordingly, the banding phenomenon occurring due to the deviation in printing position can be easily solved or made almost unnoticeable, without performing a complex correction processing, such as the correction of the color component.

Here, the 'banding phenomenon' refers to defective printing due to an uneven density having a line shape caused by the dot printing position deviation in the printing direction (the same is applied to an aspect of 'a printing apparatus', an aspect of 'a printing program', an aspect of 'a printing method', an aspect of 'a printing control device', an aspect of 'a printing control program', an aspect of 'a printing control method', an aspect of 'a recording medium having recorded thereon the program', and the description of exemplary embodiments).

The above-described 'printing direction' basically means a direction vertical to the nozzle arrangement direction. However, the printing direction may not be vertical to the nozzle arrangement direction such that the nozzle arrangement direction is not vertical to a movement direction of the printing head or a paper feed direction (the same is applied to the aspect of the printing apparatus, the aspect of the printing program, the aspect of the printing method, the aspect of the printing control device, the aspect of the printing control program, the aspect of the printing control method, the aspect of the recording medium having recorded thereon the program, and the description of exemplary embodiments).

'Printing data' is data for a printing processing, and is one of multi-level (M-level) (where $M \geqq 3$) data (document data, image data, or the like) created by a document editor or an image editor, data (N-level quantized data or the like) obtained by performing an N-level quantization processing (where $M > N \geqq 2$) on multi-level data, or data (printing control data or the like) for controlling the operation of each functional unit that performs a printing processing according to data. In this aspect, one of data is corrected (the same is applied to the aspect of the printing apparatus, the aspect of the printing program, the aspect of the printing method, the aspect of the printing control device, the aspect of the printing control program, the aspect of the printing control method, the aspect of the recording medium having recorded thereon the program, and the description of exemplary embodiments).

The 'dot' refers to a region where ink ejected from one or several nozzles lands onto a printing medium. In addition, an area of the dot is not zero, and has a constant size (that is, an area). There are several kinds of dots per size. However, the dot formed by the ejected ink is not a necessarily circle. For example, when the dot is formed to have a shape other than the circle, such as an ellipse, its average diameter is set as a dot diameter. Further, on an assumption that a dot is equivalent to a circle having the same area as the dot formed of the ejected ink having a predetermined amount, a diameter of the equivalent dot may be set as the dot diameter. In addition, a method of ejecting dots having different densities may include a method of ejecting dots having the same size but different densities from each other, a method of ejecting the dots having the same density but different sizes from each other, a method of overlapping the dots while ejecting the dots having the same density but different ejection amounts of ink from each other to make their densities different, and the like. In addition, when one ink drop ejected from one nozzle is separated and lands, this is also referred to as one dot. Further, when at least two dots are stuck together which are formed from two nozzles or one nozzle with a time shift, these are referred to as two dots (the same is applied to the aspect of the printing apparatus, the aspect of the printing program, the aspect of the printing method, the aspect of the printing control device, the aspect of the printing control program, the aspect of the printing control method, the aspect of the recording medium having recorded thereon the program, and the description of exemplary embodiments).

The 'dot printing line' refers to a column of dots to be printed by nozzles of several nozzle modules printing the same line, and refers to a column of dots to be printed by nozzles of other nozzle modules including the abnormal nozzle and printing the same line as the abnormal nozzle where the dot printing position is deviated by not less than the predetermined distance from the ideal dot printing position, or a column of dots to be printed by only normal nozzles where all the nozzles printing the same line are in normal states (the same is applied to the aspect of the printing apparatus, the aspect of the printing program, the aspect of the printing method, the aspect of the printing control device, the aspect of the printing control program, the aspect of the printing control method, the aspect of the recording medium having recorded thereon the program, and the description of exemplary embodiments).

The 'density' refers to a degree of brightness of the printed portion, and a brightness of a portion where the dots are not printed, that is, a background color of a printing paper, is set to a minimum density. Further, a brightness of a portion where black dots or dots of respective colors overlap is set to a maximum density (the same is applied to the aspect of the printing apparatus, the aspect of the printing program, the aspect of the printing method, the aspect of the printing control device, the aspect of the printing control program, the aspect of the printing control method, the aspect of the recording medium having recorded thereon the program, and the description of exemplary embodiments).

The 'ideal dot printing position' is, for example, uniquely determined by resolution. Accordingly, in case of resolution of 720 dpi, when dot formation regions are equally divided so as to set a distance between adjacent lattice points (longitudinal and lateral directions) to a printing interval (35.28 μm) determined by the resolution (720 dpi), as shown in FIG. 26, a position where a center of each dot lands (formed) on the lattice point becomes the ideal dot position.

An ideal printing interval is 1 inch=2.54 cm=25400 μm, such that '25400 μm/720 dpi≅35.28 μm' can be calculated in case of the resolution of 720 dpi, and about 70.56 μm in case of 360 dpi, and about 141.1 μm in case of 180 dpi.

A method of determining the origin (center) at the time of forming dots in the ideal dot position uses an ink landing position of a first nozzle as a reference. In this case, a central coordinate is assumed as a coordinate representing the dots (the same is applied to the aspect of the printing apparatus, the aspect of the printing program, the aspect of the printing method, the aspect of the printing control device, the aspect of the printing control program, the aspect of the printing control method, the aspect of the recording medium having recorded thereon the program, and the description of exemplary embodiments).

The 'correction' includes a correction for increasing or decreasing the density value represented by printing data before correction or setting the value before correction as a base, or a correction for setting a new value regardless of the value before correction, and so forth (the same is applied to the aspect of the printing apparatus, the aspect of the printing program, the aspect of the printing method, the aspect of the printing control device, the aspect of the printing control program, the aspect of the printing control method, the aspect of the recording medium having recorded thereon the program, and the description of exemplary embodiments).

The 'density correction unit' may correct printing data related to only the abnormal nozzle among the nozzles including the abnormal nozzle and printing the same line as the abnormal nozzle, correct printing data related to the abnormal nozzle and printing data related to other normal nozzles (for example, printing data of only normal nozzles to be corrected when a plurality of normal nozzles exist), or correct printing data related to only normal nozzles (for example, printing data of the normal nozzles to be corrected when a plurality of normal nozzles exist). Any one of these correction methods may be set in advance, and the most suitable one may be selected according to processing conditions, such as a processing speed or a processing result (the same is applied to the aspect of the printing apparatus, the aspect of the printing program, the aspect of the printing method, the aspect of the printing control device, the aspect of the printing control program, the aspect of the printing control method, the aspect of the recording medium having recorded thereon the program, and the description of exemplary embodiments).

Second Aspect

According to a second aspect of the invention, in the printing apparatus according to the first aspect, the density correction unit may correct printing data corresponding to the dot printing line to be printed by the nozzles including the abnormal nozzle and printing the same line as the abnormal nozzle such that a dot printing pitch of each of the nozzles including the abnormal nozzle and printing the same line as the abnormal nozzle becomes a pitch for making a density of the dot printing line printed by the nozzles including the abnormal nozzle and printing the same line as the abnormal nozzle close to the densities of other dot printing lines to be printed by only the normal nozzles.

That is, in this aspect, as specific means for making the density of the dot printing line to be printed by the nozzles including the abnormal nozzle and printing the same line as the abnormal nozzle close to the densities of other dot printing lines to be printed by only the normal nozzles in the first aspect, the dot printing pitch of each of the nozzles including the abnormal nozzle and printing the same line as the abnormal nozzle is corrected.

Accordingly, the density of the dot printing line to be printed by the abnormal nozzle can be easily corrected to the densities of the dot printing lines to be printed by other normal nozzles.

In this aspect, since the dot printing pitch of the line having the printing position deviation is merely changed, it can be easily implemented compared to the method of preparing the color conversion table for color matching as described above.

Meanwhile, the dot printing pitch of this apparatus does not represent the dot pitch between dots itself, but means an average value between several dots, because correction of luminance by means of an area gray-scale level suffice for an image represented by the area gray-scale level. Meanwhile, when the dot pitch is freely changed, the dot position can be corrected without causing overlap dots, such that the problems inherent in the related art do not occur. The same is applied to the following descriptions.

The correction of the dot printing pitch may refer to a correction of the pitch of the abnormal nozzle only, a correction of the pitches of both the abnormal nozzle and other normal nozzles, or a correction of the pitches of the normal nozzles only (the same is applied to the aspect of the printing apparatus, the aspect of the printing program, the aspect of the printing method, the aspect of the printing control device, the aspect of the printing control program, the aspect of the printing control method, the aspect of the recording medium having recorded thereon the program, and the description of exemplary embodiments).

Third Aspect

According to a third aspect of the invention, in the printing apparatus according to the second aspect, the density correction unit may correct printing data corresponding to the dot printing line to be printed by the nozzles including the abnormal nozzle and printing the same line as the abnormal nozzle such that a dot printing pitch of each of the nozzles including the abnormal nozzle and printing the same line as the abnormal nozzle becomes longer than a dot printing pitch of each of the normal nozzles.

That is, the density of the dot printing line where the dot printing position is deviated generally tends to be higher than the density of the normal dot printing line.

Accordingly, in this aspect, as specific means for making the density of the dot printing line to be printed by the nozzles including the abnormal nozzle and printing the same line as the abnormal nozzle close to the densities of other dot printing lines to be printed by only the normal nozzles in the first aspect, the dot printing pitch of each of the nozzles including the abnormal nozzle and printing the same line as the abnormal nozzle becomes longer than the dot printing pitch of each of other normal nozzles. Therefore, the dot density of the dot printing line can become lower than the dot density of the normal printing line.

Accordingly, the density of the dot printing line where the printing position is deviated can be made to be almost equal to the density of the normal dot printing line, such that the banding phenomenon can be removed or made to be almost unnoticeable.

In this aspect, since the dot printing pitch of the line where the printing position is deviated merely becomes longer, it can be easily implemented compared to the method of preparing the color conversion table for color matching as described above.

As a method of 'making the printing pitch longer' includes a method of thinning out dots, which are originally printed, to make the printing pitch longer, and so forth. For example, dots are printed at one or plural dots intervals, such that the printing pitch can be made to be longer by an amount of the extracted dots. In this case, data representing the dots to be extracted among the printing data is corrected as one of which dots should not be printed (the same is applied to the aspect of the printing apparatus, the aspect of the printing program, the aspect of the printing method, the aspect of the printing control device, the aspect of the printing control program, the aspect of the printing control method, the aspect of the recording medium having recorded thereon the program, and the description of exemplary embodiments).

Fourth Aspect

According to a fourth aspect of the invention, in the printing apparatus of the first aspect, the density correction unit may correct printing data corresponding to the dot printing line to be printed by the nozzles including the abnormal nozzle and printing the same line as the abnormal nozzle such that a size of each of dots constituting the dot printing line to be printed by the nozzles including the abnormal nozzle and printing the same line as the abnormal nozzle becomes a size for making the density of the dot printing line to be printed by the nozzles including the abnormal nozzle and printing the same line as the abnormal nozzle close to the densities of other dot printing lines to be printed by only the normal nozzles.

That is, in this aspect, as specific means for making the density of the dot printing line to be printed by the nozzles including the abnormal nozzle and printing the same line as the abnormal nozzle close to the densities of other dot printing lines to be printed by only the normal nozzles in the first aspect, the size of the dots to be printed by the nozzles including the abnormal nozzle and printing the same line as the abnormal nozzle is corrected.

Accordingly, the density of the dot printing line where the printing position is deviated can be made to be almost equal to the density of the normal dot printing line, such that the banding phenomenon can be removed or made to be almost unnoticeable.

In this aspect, since the size of each of the dots to be printed by the nozzles where the printing position is deviated is merely changed, it can be easily implemented compared to the method of preparing the color conversion table for color matching as described above.

In this case, the correction of the dot size may include a correction of the dot size of the abnormal nozzle only, a correction of the dot sizes of both the abnormal nozzle and other normal nozzles, and a correction of the dot sizes of the normal nozzles only (the same is applied to the aspect of the printing apparatus, the aspect of the printing program, the aspect of the printing method, the aspect of the printing control device, the aspect of the printing control program, the aspect of the printing control method, the aspect of the recording medium having recorded thereon the program, and the description of exemplary embodiments).

Fifth Aspect

According to a fifth aspect of the invention, in the printing apparatus according to the fourth aspect, the density correction unit may correct the printing data corresponding to the dot printing line to be printed by the nozzles including the abnormal nozzle and printing the same line as the abnormal nozzle such that a size of each of dots constituting the dot printing line to be printed by the nozzles including the abnormal nozzle and printing the same line as the abnormal nozzle becomes smaller than a size of each of the dots before correction.

That is, in this aspect, as specific means for making the density of the dot printing line to be printed by the nozzles including the abnormal nozzle and printing the same line as the abnormal nozzle close to the densities of other dot printing lines to be printed by only the normal nozzles in the first aspect, the size of each of the dots to be printed by the nozzles including the abnormal nozzle and printing the same line as the abnormal nozzle is corrected to be smaller than the size before correction.

Accordingly, the density of the dot printing line where the printing position is deviated can be made to be almost equal to the density of the normal dot printing line, such that the banding phenomenon can be removed or made to be almost unnoticeable.

In this aspect, since the size of each of the dots to be printed by the nozzles where the printing position is deviated is merely changed, it can be easily implemented compared to the method of preparing the color conversion table for color matching as described above.

Sixth Aspect

According to a sixth aspect of the invention, in the printing apparatus according to the first aspect, the printing data may be M-level image data (where $M \geqq 3$).

That is, in this aspect, as specific means for making the density of the dot printing line to be printed by the nozzles including the abnormal nozzle and printing the same line as the abnormal nozzle close to the densities of other dot printing lines to be printed by only the normal nozzles in the first aspect, the pixel value image data of each of the pixels to be printed by the nozzles including the abnormal nozzle and printing the same line as the abnormal nozzle is corrected.

Accordingly, the density of the dot printing line where the printing position is deviated can be made to be almost equal to the density of the normal dot printing line, such that the banding phenomenon can be removed or made to be almost unnoticeable.

In this aspect, since the pixel values of the pixels corresponding to the dots to be printed by the nozzles where the printing position is deviated is merely changed, it can be easily implemented compared to the method of preparing the color conversion table for color matching as described above.

Meanwhile, the 'M-level (where $M \geqq 3$)' means a multi-value pixel value related to a density or luminance which is, for example, represented as 8-bit 256 gray-scale levels. Further, the 'N-level quantization (where $M > N \geqq 2$)' means a processing of classifying the pixel values of M-level (multi-value) data into N kinds based on a certain threshold value.

The 'dot size' also means that a dot does not land, as well as the size (an area) of the dot itself (the same is applied to the aspect of the printing apparatus, the aspect of the printing program, the aspect of the printing method, the aspect of the printing control device, the aspect of the printing control program, the aspect of the printing control method, the aspect of the recording medium having recorded thereon the program, and the description of exemplary embodiments).

Seventh Aspect

According to a seventh aspect of the invention, in the printing apparatus according to the sixth aspect, the density correction unit may perform correction such that the density value represented by the printing data corresponding to the dot printing line to be printed by the nozzles including the abnormal nozzle and printing the same line as the abnormal nozzle becomes smaller than the density value before correction.

That is, in this aspect, as specific means for making the density of the dot printing line to be printed by the nozzles including the abnormal nozzle and printing the same line as the abnormal nozzle close to the densities of other dot printing lines to be printed by only the normal nozzles in the first aspect, the pixel value image data of each of the pixels printed by the nozzles including the abnormal nozzle and printing the same line as the abnormal nozzle is corrected to be smaller.

Accordingly, the density of the dot printing line where the printing position is deviated can be made to be almost equal to the density of the normal dot printing line, such that the banding phenomenon can be removed or made to be almost unnoticeable.

In this aspect, since the pixel values of the pixels corresponding to the dots printed by the nozzles where the printing position is deviated merely becomes smaller, it can be easily implemented compared to the method of preparing the color conversion table for color matching as described above.

Eighth Aspect

According to an eighth aspect of the invention, a printing program used in a printing apparatus, which has a printing head having a plurality of nozzle modules corresponding to various ink colors arranged in parallel, causes a computer to execute specifying an abnormal nozzle that is deviated from an ideal dot printing position by a predetermined distance or more among nozzles constituting each of the nozzle modules of the printing head, and correcting a density of a dot printing line to be printed by the nozzles including the abnormal nozzle specified by the abnormal nozzle specifying unit and printing the same line as the abnormal nozzle. In this case, printing data corresponding to the dot printing line to be printed by the nozzles including the abnormal nozzle and printing the same line as the abnormal nozzle is corrected to be close to densities of other dot printing lines to be printed by only normal nozzles.

Accordingly, the same advantages as the first aspect can be obtained.

Most of printing apparatuses which are currently put into markets, such as ink jet printers or the like, have a computer system having a central processing unit (CPU), a storage device (RAM or ROM), input and output devices, and so forth, and the computer system can be used to implement the respective units by means of software. Therefore, the respective units can be implemented in a more economical and easy manner compared to dedicated hardware for implementing the respective units. Further, some programs can be updated to facilitate version-up of functional improvement or amelioration.

Ninth Aspect

According to a ninth aspect of the invention, in the printing program according to the eighth aspect, in the correcting of the density, printing data corresponding to the dot printing line to be printed by the nozzles including the abnormal nozzle and printing the same line as the abnormal nozzle may be corrected such that a dot printing pitch of each of the nozzles including the abnormal nozzle and printing the same line as the abnormal nozzle becomes a pitch for causing a density of the dot printing line to be printed by the nozzles including the abnormal nozzle and printing the same line as the abnormal nozzle close to the densities of other dot printing lines to be printed by only the normal nozzles.

Accordingly, the same advantages as the second aspect can be obtained.

The standard computer system prepared in most of existing printing apparatuses can be used to implement the respective units by means of software in an economical and easy manner, like the eighth aspect. Further, some programs can be updated to facilitate version-up of functional improvement or amelioration.

Tenth Aspect

According to a tenth aspect of the invention, in the printing program according to the ninth aspect, in the correcting of the density, printing data corresponding to the dot printing line to be printed by the nozzles including the abnormal nozzle and printing the same line as the abnormal nozzle may be corrected such that a dot printing pitch of each of the nozzles including the abnormal nozzle and printing the same line as the abnormal nozzle becomes longer than a dot printing pitch of each of the normal nozzles.

Accordingly, the same advantages as the third aspect can be obtained.

The standard computer system prepared in most of existing printing apparatuses can be used to implement the respective units by means of software in an economical and easy manner, like the eighth aspect. Further, some programs can be updated to facilitate version-up of functional improvement or amelioration.

Eleventh Aspect

According to an eleventh aspect of the invention, in the printing program according to the eighth aspect, in the correcting of the density, the printing data corresponding to the dot printing line to be printed by the nozzles including the abnormal nozzle and printing the same line as the abnormal nozzle may be corrected such that a size of each of dots constituting the dot printing line to be printed by the nozzles including the abnormal nozzle and printing the same line as the abnormal nozzle becomes a size for making the density of the dot printing line to be printed by the nozzles including the abnormal nozzle and printing the same line as the abnormal nozzle close to the densities of other dot printing lines to be printed by only the normal nozzles.

Accordingly, the same advantages as the fourth aspect can be obtained.

The standard computer system prepared in most of existing printing apparatuses can be used to implement the respective units by means of software in an economical and easy manner, like the eighth aspect. Further, some programs can be updated to facilitate version-up of functional improvement or amelioration.

Twelfth Aspect

According to a twelfth aspect of the invention, in the printing program according to the eighth aspect, in the correcting of the density, the printing data corresponding to the dot printing line to be printed by the nozzles including the abnormal nozzle and printing the same line as the abnormal nozzle may be corrected such that a size of each of dots constituting the dot printing line to be printed by the nozzles including the abnormal nozzle and printing the same line as the abnormal nozzle becomes smaller than a size of each of the dots before correction.

Accordingly, the same advantages as the fifth aspect can be obtained.

The standard computer system prepared in most of existing printing apparatuses can be used to implement the respective units by means of software in an economical and easy manner, like the eighth aspect. Further, some programs can be updated to facilitate version-up of functional improvement or amelioration.

Thirteenth Aspect

According to a thirteenth aspect of the invention, in the printing program according to the eighth aspect, the printing data may be M-level image data (where M≧3).

Accordingly, the same advantages as the sixth aspect can be obtained.

The standard computer system prepared in most of existing printing apparatuses can be used to implement the respective units by means of software in an economical and easy manner, like the eighth aspect. Further, some programs can be updated to facilitate version-up of functional improvement or amelioration.

Fourteenth Aspect

According to a fourteenth aspect of the invention, in the printing program according to the eighth aspect, in the correcting of the density, the density value represented by the printing data corresponding to the dot printing line to be printed by the nozzles including the abnormal nozzle and printing the same line as the abnormal nozzle may be corrected to be smaller than the density value before correction.

Accordingly, the same advantages as the seventh aspect can be obtained.

The standard computer system prepared in most of existing printing apparatuses can be used to implement the respective units by means of software in an economical and easy manner, like the eighth aspect. Further, some programs can be updated to facilitate version-up of functional improvement or amelioration.

Fifteenth Aspect

According to a fifteenth aspect of the invention, there is provided a computer readable recording medium having recorded thereon the printing program according to any one of the eighth to fourteenth aspects.

Accordingly, the printing program according to any one of the eighth to fourteenth aspects can be surely and easily provided to consumers, such as users, via a computer readable storage medium, such as CD-ROM, DVD-ROM, FD, a semiconductor chip, or the like.

Sixteenth Aspect

A printing method, which uses a printing head having a plurality of nozzle modules corresponding to various ink colors arranged in parallel, includes specifying an abnormal nozzle that is deviated from an ideal dot printing position by a predetermined distance or more among nozzles constituting each of the nozzle modules of the printing head, and correcting a density of a dot printing line to be printed by the nozzles including the abnormal nozzle specified by the abnormal nozzle specifying unit and printing the same line as the abnormal nozzle. In the correcting of the density, printing data corresponding to the dot printing line to be printed by the nozzles including the abnormal nozzle and printing the same line as the abnormal nozzle may be corrected to be close to densities of other dot printing lines printed by only normal nozzles.

Accordingly, the same advantages as the first aspect can be obtained.

Seventeenth Aspect

According to a seventeenth aspect of the invention, in the printing method of the sixteenth aspect, in the correcting of the density, printing data corresponding to the dot printing line to be printed by the nozzles including the abnormal nozzle and printing the same line as the abnormal nozzle may be corrected such that a dot printing pitch of each of the nozzles including the abnormal nozzle and printing the same line as the abnormal nozzle becomes a pitch for making the density of the dot printing line to be printed by the nozzles including the abnormal nozzle and printing the same line as the abnormal nozzle close to the densities of other dot printing lines to be printed by only the normal nozzles.

Accordingly, the same advantages as the second aspect can be obtained.

Eighteenth Aspect

According to an eighteenth aspect of the invention, in the printing method according to the seventeenth aspect, in the correcting of the density, printing data corresponding to the dot printing line to be printed by nozzles including the abnormal nozzle and printing the same line as the abnormal nozzle may be corrected such that the dot printing pitch of each of the nozzles including the abnormal nozzle and printing the same line as the abnormal nozzle becomes longer than a dot printing pitch of each of the normal nozzles.

Accordingly, the same advantages as the third aspect can be obtained.

Nineteenth Aspect

According to a nineteenth aspect of the invention, in the printing method of the sixteenth aspect, in the correcting of the density, the printing data corresponding to the dot printing line to be printed by the nozzles including the abnormal nozzle and printing the same line as the abnormal nozzle may be corrected such that a size of each of dots constituting the dot printing line to be printed by the nozzles including the abnormal nozzle and printing the same line as the abnormal nozzle becomes a size for making the density of the dot printing line to be printed by the nozzles including the abnormal nozzle and printing the same line as the abnormal nozzle close to the densities of other dot printing lines to be printed by only the normal nozzles.

Accordingly, the same advantages as the fourth aspect can be obtained.

Twentieth Aspect

According to a twentieth aspect of the invention, in the printing method according to the sixteenth aspect, in the correcting of the density, the printing data corresponding to the dot printing line to be printed by the nozzles including the abnormal nozzle and printing the same line as the abnormal nozzle may be corrected such that a size of each of dots constituting the dot printing line to be printed by the nozzles including the abnormal nozzle and printing the same line as the abnormal nozzle becomes smaller than a size of each of the dots before correction.

Accordingly, the same advantages as the fifth aspect can be obtained.

Twenty-First Aspect

According to a twenty-first aspect of the invention, in the printing method according to the sixteenth aspect, the printing data may be M-level image data (where M≧3).

Accordingly, the same advantages as the sixth aspect can be obtained.

Twenty-Second Aspect

According to a twenty-second aspect of the invention, in the printing method according to the sixteenth aspect, in the correcting of the density, the density value represented by the printing data corresponding to the dot printing line to be printed by the nozzles including the abnormal nozzle and printing the same line as the abnormal nozzle may be corrected to be smaller than the density value before correction.

Accordingly, the same advantages as the seventh aspect can be obtained.

Twenty-Third Aspect

According to a twenty-third aspect of the invention, a printing control device of controlling a printing apparatus, which has a printing head having a plurality of nozzle modules corresponding to various ink colors arranged in parallel, includes an abnormal nozzle specifying unit that specifies an abnormal nozzle that is deviated from an ideal dot printing position by a predetermined distance or more among nozzles constituting each of the nozzle modules of the printing head, and a density correction unit that corrects a density of a dot printing line to be printed by the nozzles including the abnormal nozzle specified by the abnormal nozzle specifying unit and printing the same line as the abnormal nozzle. The density correction unit corrects printing data corresponding to the dot printing line to be printed by the nozzles including the abnormal nozzle and printing the same line as the abnormal nozzle close to densities of the dot printing lines to be printed by only normal nozzles.

Accordingly, the same advantages as the printing apparatus of the first aspect can be obtained.

The device can be implemented by other systems than a printer, including a general-use computer system such as a PC and an IC for specific purpose such as an ASIC or the like (the same is applied to the aspect of the printing apparatus, the aspect of the printing program, the aspect of the printing method, the aspect of the printing control device, the aspect of the printing control program, the aspect of the printing control method, the aspect of the recording medium having recorded thereon the program, and the description of exemplary embodiments).

Twenty-Fourth Aspect

According to a twenty-fourth aspect of the invention, in the printing control device according to the twenty-third aspect, the density correction unit may correct printing data corresponding to the dot printing line to be printed by the nozzles including the abnormal nozzle and printing the same line as the abnormal nozzle such that a dot printing pitch of each of the nozzles including the abnormal nozzle and printing the same line as the abnormal nozzle becomes a pitch for making the density of the dot printing line to be printed by the nozzles including the abnormal nozzle and printing the same line as the abnormal nozzle close to the densities of other dot printing lines to be printed by only the normal nozzles.

Accordingly, the same advantages as the second and twenty-third aspects can be obtained.

Twenty-Fifth Aspect

According to a twenty-fifth aspect of the invention, in the printing control device according to the twenty-fourth aspect, the density correction unit may correct printing data corresponding to the dot printing line to be printed by the nozzles including the abnormal nozzle and printing the same line as the abnormal nozzle such that the dot printing pitch of the nozzle including the abnormal nozzle and printing the same line as the abnormal nozzle becomes longer than a dot printing pitch of each of the normal nozzles.

Accordingly, the same advantages as the third and twenty-third aspects can be obtained.

Twenty-Sixth Aspect

According to a twenty-sixth aspect of the invention, in the printing control device according to the twenty-third aspect, the density correction unit may correct the printing data corresponding to the dot printing line to be printed by the nozzles including the abnormal nozzle and printing the same line as the abnormal nozzle such that a size of each of dots constituting the dot printing line to be printed by the nozzles including the abnormal nozzle and printing the same line as the abnormal nozzle becomes a size for making the density of the dot printing line to be printed by the nozzles including the abnormal nozzle and printing the same line as the abnormal nozzle close to the densities of other dot printing lines to be printed by only the normal nozzles.

Accordingly, the same advantages as the fourth and twenty-third aspects can be obtained.

Twenty-Seventh Aspect

According to a twenty-seventh aspect of the invention, in the printing control device according to the twenty-sixth aspect, the density correction unit may correct the printing data corresponding to the dot printing line to be printed by the nozzles including the abnormal nozzle and printing the same line as the abnormal nozzle such that a size of each of dots constituting the dot printing line to be printed by the nozzles including the abnormal nozzle and printing the same line as the abnormal nozzle becomes smaller than a size of each of the dots before correction.

Accordingly, the same advantages as the fifth and twenty-third aspects can be obtained.

Twenty-Eighth Aspect

According to a twenty-eighth aspect of the invention, in the printing control device according to the twenty-third aspect, the printing data may be M-level image data (where $M \geqq 3$).

Accordingly, the same advantages as the sixth and twenty-third aspects can be obtained.

Twenty-Ninth Aspect

According to a twenty-ninth aspect, in the printing control device according to the twenty-eighth aspect, the density correction unit may perform correction such that the density value represented by the printing data corresponding to the dot printing line to be printed by the nozzles including the abnormal nozzle and printing the same line as the abnormal nozzle becomes smaller than the density value before correction.

Accordingly, the same advantages as the seventh and twenty-third aspects can be obtained.

Thirtieth Aspect

According to a thirtieth aspect of the invention, a printing control program used in a printing control device of controlling a printing apparatus, which has a printing head having a plurality of nozzle modules corresponding to various ink colors arranged in parallel, causes a computer to execute specifying an abnormal nozzle that is deviated from an ideal dot printing position by a predetermined distance or more among nozzles constituting each of the nozzle modules of the printing head, and correcting a density of a dot printing line to be printed by the nozzles including the abnormal nozzle specified by the abnormal nozzle specifying unit and printing the same line as the abnormal nozzle. The density correction unit corrects printing data corresponding to the dot printing line to be printed by the nozzles including the abnormal nozzle and printing the same line as the abnormal nozzle close to densities of other dot printing lines to be printed by only normal nozzles.

Accordingly, the same advantages as the first and twenty-third aspects can be obtained.

Thirty-First Aspect

According to a thirty-first aspect of the invention, in the printing control program according to the thirtieth aspect, in the correcting of the density, printing data corresponding to the dot printing line to be printed by the nozzles including the abnormal nozzle and printing the same line as the abnormal nozzle may be corrected such that a dot printing pitch of each of the nozzles including the abnormal nozzle and printing the same line as the abnormal nozzle becomes a pitch for making the density of the dot printing line to be printed by the nozzles including the abnormal nozzle and printing the same line as the abnormal nozzle close to the densities of other dot printing lines to be printed by only the normal nozzles.

Accordingly, the same advantages as the second and twenty-third aspects can be obtained.

Thirty-Second Aspect

According to a thirty-first aspect of the invention, in the printing control program according to the thirty-first aspect, in the correcting of the density, printing data corresponding to the dot printing line printed by the nozzles including the abnormal nozzle and printing the same line as the abnormal nozzle may be corrected such that a dot printing pitch of each of the nozzles including the abnormal nozzle and printing the same line as the abnormal nozzle becomes longer than a dot printing pitch of each of the normal nozzles.

Accordingly, the same advantages as the third and twenty-third aspects can be obtained.

Thirty-Third Aspect

According to a thirty-third aspect of the invention, in the printing control program according to the thirtieth aspect, in the correcting of the density, the printing data corresponding to the dot printing line to be printed by the nozzles including the abnormal nozzle and printing the same line as the abnormal nozzle may be corrected such that a size of each of dots constituting the dot printing line to be printed by the nozzles including the abnormal nozzle and printing the same line as the abnormal nozzle becomes a size for making the density of the dot printing line to be printed by the nozzles including the abnormal nozzle and printing the same line as the abnormal nozzle close to the densities of other dot printing lines to be printed by only the normal nozzles.

Accordingly, the same advantages as the fourth and twenty-third aspects can be obtained.

Thirty-Fourth Aspect

According to a thirty-first aspect of the invention, in the printing control program according to the thirtieth aspect, in the correcting of the density, the printing data corresponding to the dot printing line to be printed by the nozzles including the abnormal nozzle and printing the same line as the abnormal nozzle may be corrected such that a size of each of dots constituting the dot printing line printed by the nozzles including the abnormal nozzle and printing the same line as the abnormal nozzle becomes smaller than a size of the dots before correction.

Accordingly, the same advantages as the fifth and twenty-third aspects can be obtained.

Thirty-Fifth Aspect

According to a thirty-fifth aspect of the invention, in the printing control program according to the thirtieth aspect, the printing data may be M-level image data (where $M \geqq 3$).

Accordingly, the same advantages as the sixth and twenty-third aspects can be obtained.

Thirty-Sixth Aspect

According to a thirty-sixth aspect of the invention, in the printing control program according to the thirtieth aspect, in the correcting of the density, the density value represented by the printing data corresponding to the dot printing line to be printed by the nozzles including the abnormal nozzle and printing the same line as the abnormal nozzle may be corrected to be smaller than the density value before correction.

Accordingly, the same advantages as the seventh and twenty-third aspects can be obtained.

Thirty-Seventh Aspect

According to a thirty-seventh aspect of the invention, there is provided a computer readable recording medium having recorded thereon the printing control program according to any one of the thirtieth to thirty-sixth aspects.

Accordingly, the printing program according to any one of the thirtieth to thirty-sixth aspect can be surely and easily provided to consumers, such as users, via a computer readable storage medium, such as CD-ROM, DVD-ROM, FD, a semiconductor chip, or the like.

Thirty-Eighth Aspect

According to a thirty-eighth aspect of the invention, a printing control method of a printing apparatus, which has a printing head having a plurality of nozzle modules corresponding to various ink colors arranged in parallel, includes specifying an abnormal nozzle that is deviated from an ideal dot printing position by a predetermined distance or more among nozzles constituting each of the nozzle modules of the printing head, and correcting a density of a dot printing line to be printed by nozzles including the abnormal nozzle specified by the abnormal nozzle specifying unit and printing the same line as the abnormal nozzle. Printing data corresponding to the dot printing line to be printed by the nozzles including the abnormal nozzle and printing the same line as the abnormal nozzle is corrected to be close to densities of other dot printing lines to be printed by only normal nozzles.

Accordingly, the same advantages as the first and twenty-third aspects can be obtained.

Thirty-Ninth Aspect

According to a thirty-ninth aspect of the invention, in the printing control method according to the thirty-eighth aspect, in the correcting of the density, printing data corresponding to the dot printing line to be printed by the nozzles including the abnormal nozzle and printing the same line as the abnormal nozzle may be corrected such that a dot printing pitch of each of the nozzles including the abnormal nozzle and printing the same line as the abnormal nozzle becomes a pitch for making a density of the dot printing line to be printed by the nozzles including the abnormal nozzle and printing the same line as the abnormal nozzle close to the densities of other dot printing lines to be printed by only the normal nozzles.

Accordingly, the same advantages as the second and twenty-third aspects can be obtained.

Fortieth Aspect

According to a fortieth aspect of the invention, in the printing control method according to the thirty-ninth aspect, in the correcting of the density, printing data corresponding to the dot printing line to be printed by the nozzles including the abnormal nozzle and printing the same line as the abnormal nozzle may be corrected such that the dot printing pitch of each of the nozzles including the abnormal nozzle and printing the same line as the abnormal nozzle becomes longer than a dot printing pitch of each of the normal nozzles.

Accordingly, the same advantages as the third and twenty-third aspects can be obtained.

Forty-First Aspect

According to a forty-first aspect of the invention, in the printing control method according to the thirty-eighth aspect, in the correcting of the density, the printing data corresponding to the dot printing line to be printed by the nozzles including the abnormal nozzle and printing the same line as the abnormal nozzle may be corrected such that a size of each of dots constituting the dot printing line to be printed by the nozzles including the abnormal nozzle and printing the same line as the abnormal nozzle becomes a size for making the density of the dot printing line to be printed by the nozzles including the abnormal nozzle and printing the same line as the abnormal nozzle close to the densities of other dot printing lines to be printed by only the normal nozzles.

Accordingly, the same advantages as the fourth and twenty-third aspects can be obtained.

Forty-Second Aspect

According to a forty-second aspect of the invention, in the printing control method according to the thirty-eighth aspect, in the correcting of the density, the printing data corresponding to the dot printing line to be printed by the nozzles including the abnormal nozzle and printing the same line as the abnormal nozzle may be corrected such that a size of each of dots constituting the dot printing line to be printed by the nozzles including the abnormal nozzle and printing the same line as the abnormal nozzle becomes smaller than a size of each of the dots before correction.

Accordingly, the same advantages as the fifth and twenty-third aspects can be obtained.

Forty-Third Aspect

According to a forty-third aspect of the invention, in the printing program according to the thirty-eighth aspect, the printing data may be M-level image data (where $M \geqq 3$).

Accordingly, the same advantages as the sixth and twenty-third aspects can be obtained.

Forty-Fourth Aspect

According to a forty-fourth aspect of the invention, in the printing control method according to the thirty-eighth aspect, in the correcting of the density, the density value represented by the printing data corresponding to the dot printing line to be printed by the nozzles including the abnormal nozzle and printing the same line as the abnormal nozzle may be corrected to be smaller than the density value before correction.

Accordingly, the same advantages as the seventh and twenty-third aspects can be obtained.

BRIEF DESCRIPTION OF THE DRAWINGS

The invention will be described with reference to the accompanying drawings, wherein like numbers reference like elements.

FIG. 5 is a view illustrating a dot-gray-scale level conversion table representing pixel values referred to make N-level data, N values, and relationship between these N values and dot sizes.

DESCRIPTION OF EXEMPLARY EMBODIMENTS

Hereinafter, embodiments of the invention will be described in detail with reference to the accompanying drawings.

FIGS. 1 to 19 relate to a printing apparatus 100, a printing program, a printing method, a printing control device, a printing control program, a printing control method, and a computer readable recording medium having recorded thereon the program according to a first embodiment of the invention.

Figure 1:
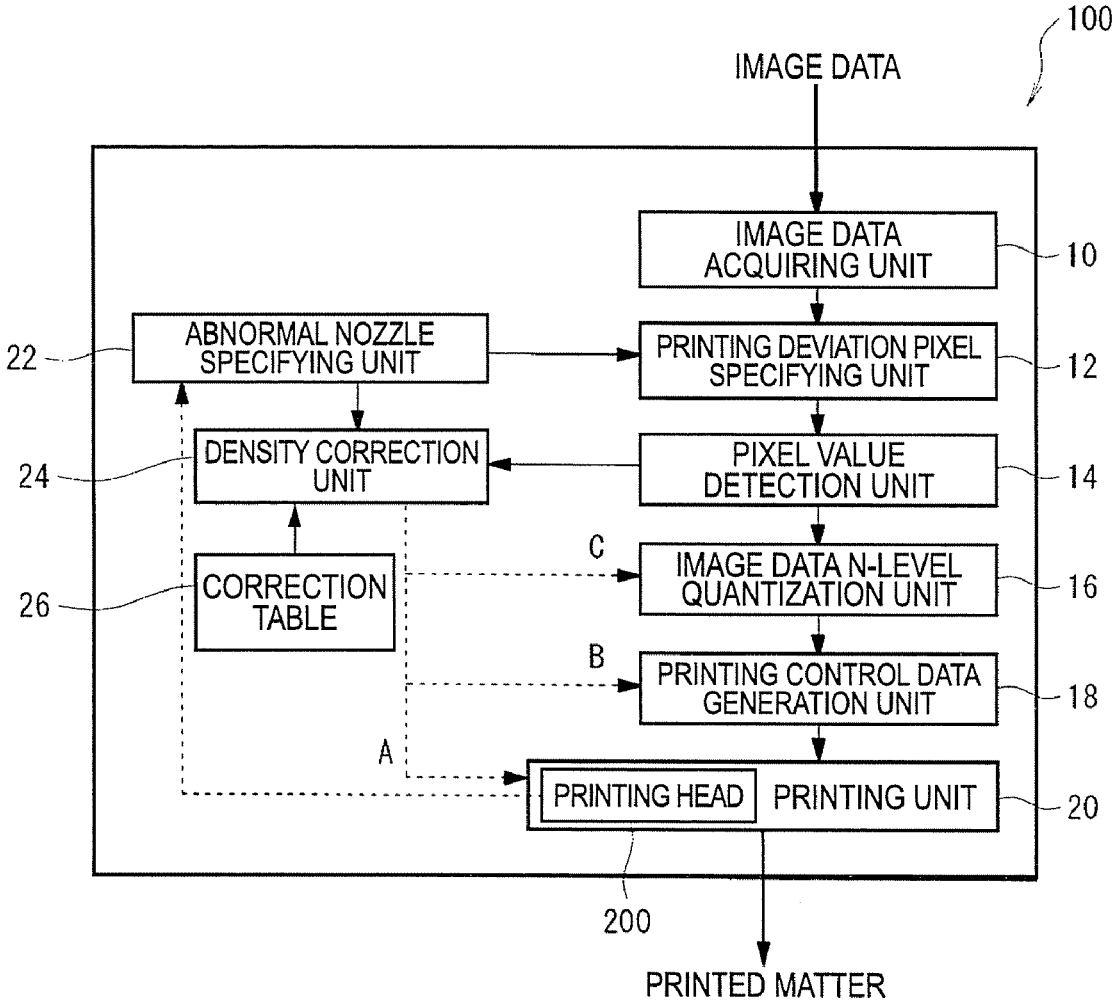
FIG. 1 is a functional block diagram of a printing apparatus according to an embodiment of the invention.

FIG. 1 is a functional block diagram illustrating a printing apparatus 100 according to an embodiment of the invention.

As shown in FIG. 1, the printing apparatus 100 is configured to include a printing head 200 having several nozzles, an image data acquiring unit 10 of acquiring multi-level image data provided for printing, a printing deviation pixel specifying unit 12 of specifying a pixel corresponding to an abnormal nozzle among pixels constituting the image data acquired by the image data acquiring unit 10, a pixel value detection unit 14 of detecting a pixel value of the pixel having the printing deviation specified by the printing deviation pixel specifying unit 12, an image data N-level quantization unit 16 of making the image data acquired by the image data acquiring unit 10 be N-level per pixel, a printing control data generation unit 18 of generating the printing control data defining dots with a predetermined size per pixel of the N-level data by the image data N-level quantization unit 16, a printing unit 20 of printing the printing control data generated by the printing control data generation unit 18 using the printing head 200, an abnormal nozzle specifying unit 22 of specifying an abnormal nozzle having a dot printing position deviation not less than a predetermined distance with respect to a printing direction among nozzles constituting the respective nozzle modules of the printing head 200, and a density correction unit 24 of correcting the density of the dot printing line printed by the nozzles in charge of printing of the same line as the corresponding abnormal nozzle including the abnormal nozzle specified by the abnormal nozzle specifying unit, which will be described in detail.

The printing head 200 that is applied to the invention will be first described.

Figure 3:
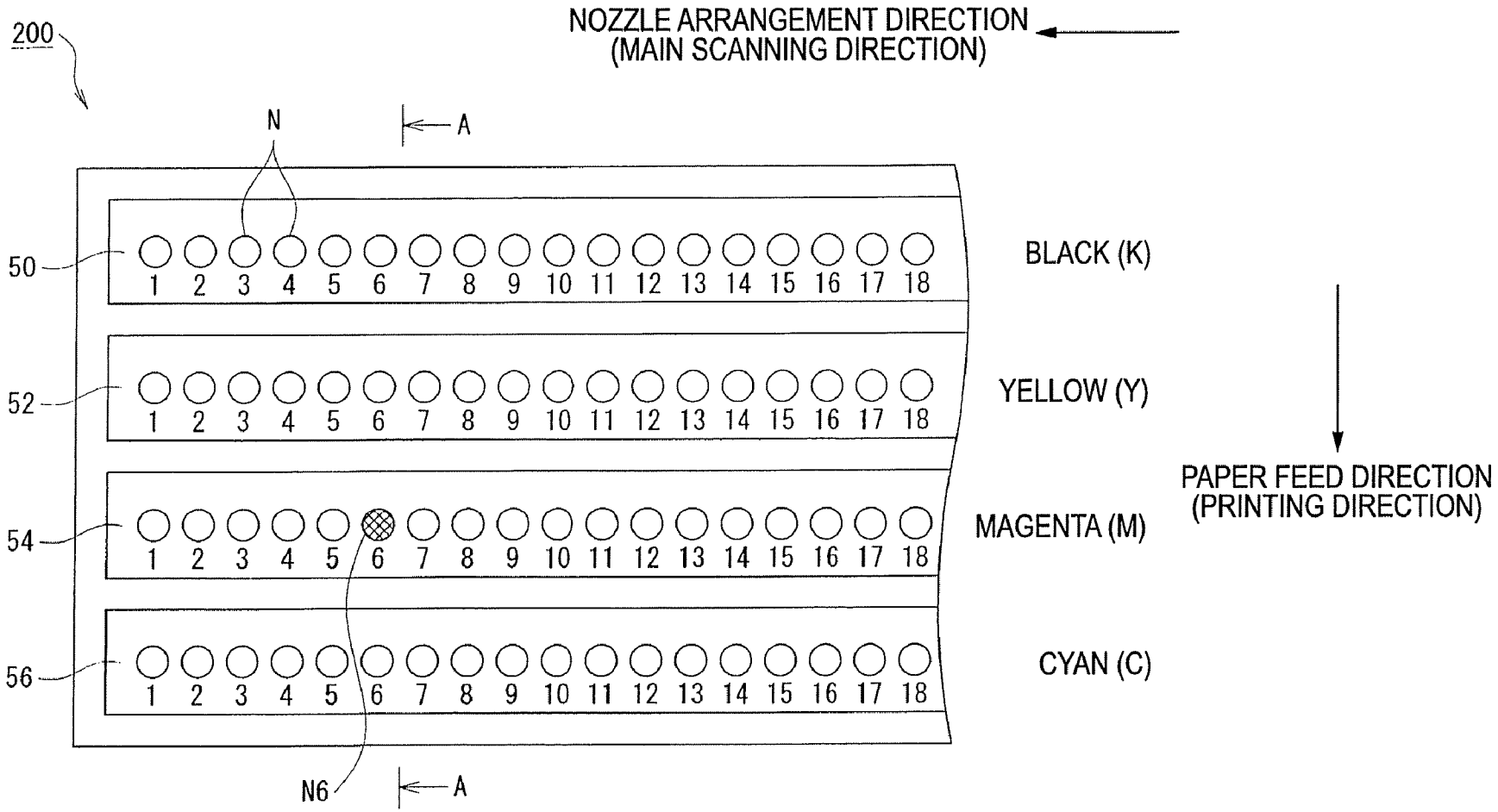
FIG. 3 is a partially enlarged bottom view of a structure of a printing head.

FIG. 3 is a partially enlarged bottom view illustrating a structure of the printing head 200.

As shown in FIG. 3, the printing head 200 has four arranged nozzle modules 50, 52, 54, and 56 which overlap each other in a paper feed direction (that is, a printing direction or a sub scanning direction), the four modules are a black nozzle module 50 which has a long ruler structure extending in a widthwise direction of the printing paper used for a line head printer (that is, printing apparatus) and has a plurality of dedicated nozzles (N) for ejecting black (K) ink (eighteen in the drawing) in the main scanning direction, a yellow nozzle module 52 which has a plurality of dedicated nozzles (N) for ejecting yellow (Y) ink arranged in a linear shape in the main scanning direction, a magenta nozzle module 54 which has a plurality of dedicated nozzles (N) for ejecting magenta (M) ink arranged in a linear shape in the main scanning direction, and a cyan nozzle module 56 which has a plurality of dedicated nozzles (N) for ejecting cyan (C) ink arranged in a linear shape in the main scanning direction. Meanwhile, in a case of the printing head for an image of high quality, nozzle modules for six or seven colors having a dedicated light magenta module for ejecting light magenta (LM) ink, or a dedicated light cyan module for ejecting light cyan (LC) ink may be implemented.

The printing head 200 having such a structure ejects ink supplied into respective ink chambers (not shown) prepared in the respective nozzles (N1, N2, N3, . . . ) by means of piezoelectric elements, such as piezoelectric actuators (not shown) prepared in the respective ink chambers, thereby printing dots of about circular shape (landing ink) on a printing paper of white color while simultaneously controlling a voltage applied to the piezoelectric elements in a multi-stage to control amounts of ejected ink from the ink chambers, such that dots having different sizes from each other per each nozzle (N1, N2, N3, . . . ) can be printed. In addition, the size of the dot which can be printed in this embodiment has four patterns (sizes) including 'No dots' as described later.

In the printing head 200 having such a fine and accurate structure, a flying curve phenomenon may occur that ink are not ejected in the ideal direction due to deviation of an ink ejection hole direction of the respective nozzles (N1, N2, N3, . . . ) in the manufacture step.

Figure 4:
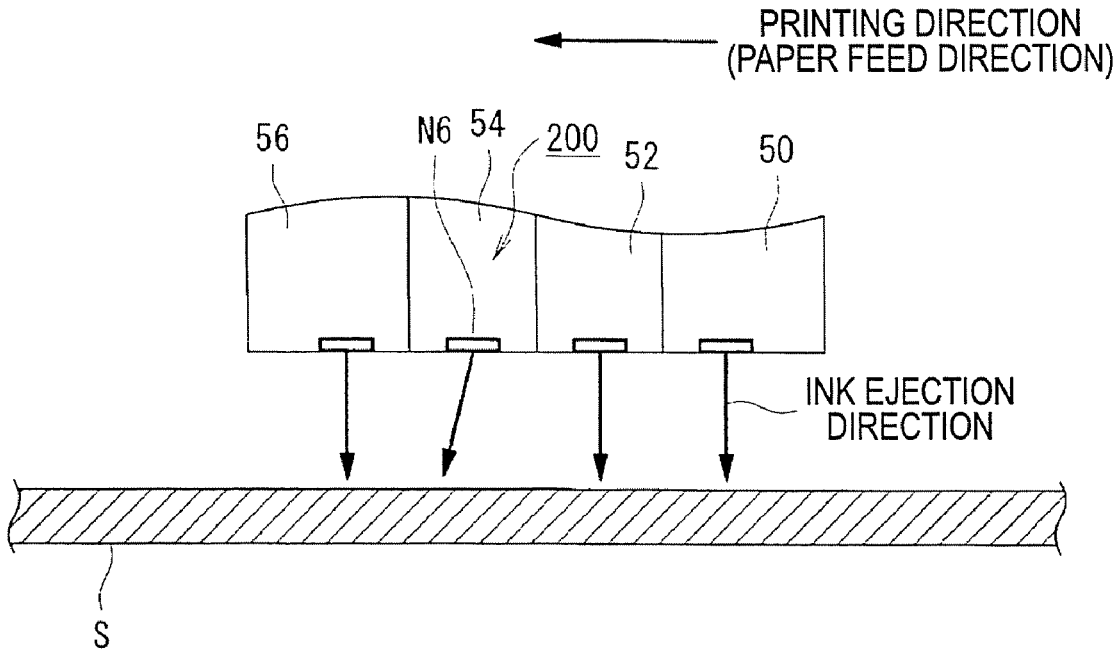
FIG. 4 is a cross-sectional view taken along IV-IV line of FIG. 3.

For example, as shown in FIGS. 3 and 4, among four nozzle modules 50, 52, 54, and 56 constituting the printing head 200, when the sixth nozzle N6 from left of the magenta nozzle module 54 causes the flying curve phenomenon to have an ink ejection direction inclined in the printing direction, a printing position of the dot printed by the abnormal nozzle N6 may be deviated to the printing direction from the printing position of the dot printed by the normal nozzles adjacent to the abnormal nozzle of the magenta nozzle module 54.

Figure 6:
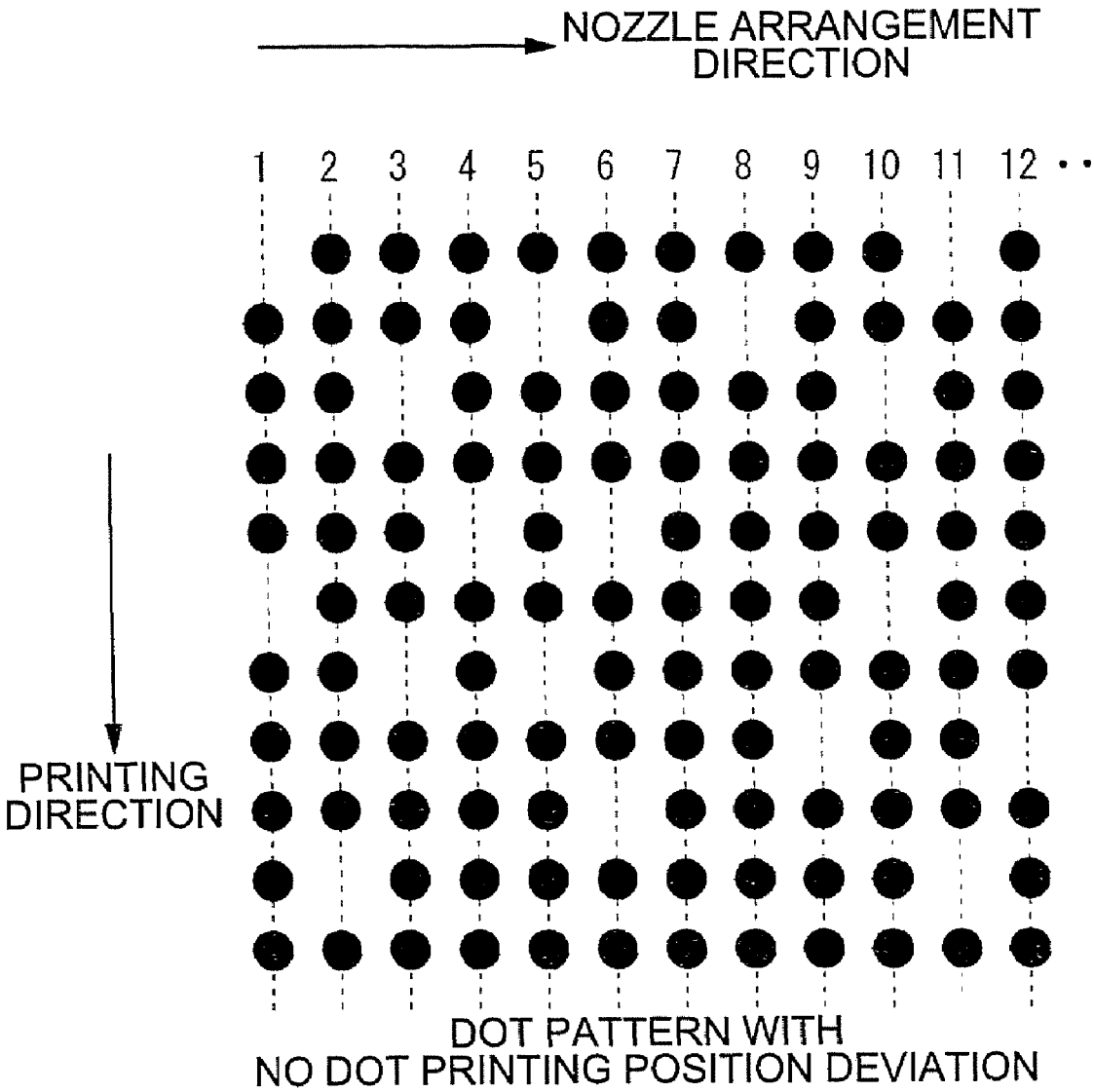
FIG. 6 is a schematic view illustrating an example of dot pattern where dot printing is not deviated.
Figure 7:
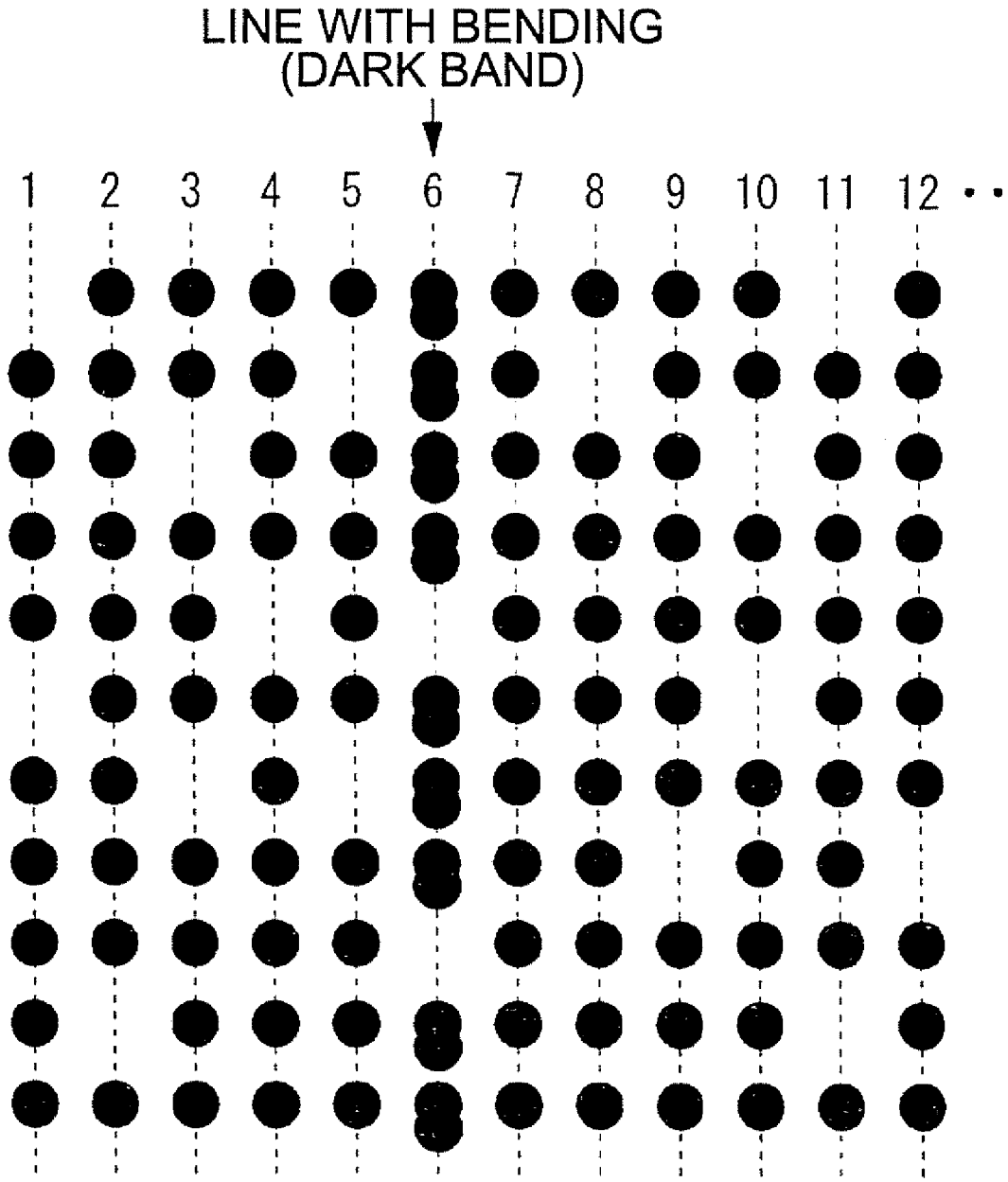
FIG. 7 is a schematic view illustrating an example of dot pattern where dot printing is deviated to cause a banding phenomenon.

FIG. 6 illustrates an ideal dot pattern without having a dot printing position deviation per dot when dots of at least two colors are printed while overlapping each other almost 100% on predetermined dot printing positions, and when the dot printing position of the nozzle N6 only of the magenta nozzle module 54 is deviated from the printing direction as shown in FIG. 4, dots printed by the nozzle N6 and dots printed by other nozzles (for example, nozzles for printing in the nozzle N6 of the cyan nozzle module 56) positioned before and after the printing direction with respect to the nozzle N6 partially overlap each other such that they are printed while being deviated with each other as shown in FIG. 7.

As a result, as shown in FIG. 7, a density (luminance) of the dot printing line (6) region printed by the nozzle N6 is changed by a density of an adjacent dot printing line or more, which thus causes a banding phenomenon that a deep stripe becomes perceived in the changed portion.

The characteristic of the printing head 200 is fixed to some extent in the manufacturing step, such that that it is rarely changed after manufacturing, except for defective ejection due to ink clogging or the like.

Next, the image data acquiring unit 10 acquires multi-level (M-level) color image data for printing and supplied from a printing instructing device (not shown) via a network, such as a PC or a print server connected to the printing apparatus 100, or acquires the multi-level color image data which are directly read from an image (data) reading device, such as a scanner or a CD-ROM drive (not shown), and also has the acquired multi-level color image data subjected to color conversion to convert them into multi-level CMYK (in case of four colors) data corresponding to respective ink when the acquired multi-level color image data are multi-level RGB data, for example, image data that are represented by a gray-scale level of 8 bits (a density value) of each color (R, G, or B) per one pixel and 256 gray-scale levels (0 to 255).

The printing deviation pixel specifying unit 12 specifies a pixel corresponding to the abnormal nozzle based on the abnormal nozzle specification information acquired by the abnormal nozzle specifying unit 22 to be described later among pixels constituting the image data acquired by the image data acquiring unit 10.

The pixel value detection unit 14 detects a pixel value of the pixel having the printing deviation specified by the printing deviation pixel specifying unit 12. For example, when the pixel value (density value or luminance value) of each of 'C', 'M', 'Y', and 'K' corresponding to the pixel having the printing deviation is represented with 8 bits 256 gray-scale levels, the pixel value of each of 'C', 'M', 'Y', and 'K' is specified in the range of 0 to 255.

The image data N-level quantization unit 16 then makes the multi-level image data acquired by the image data acquiring unit 10 N-level per pixel to generate N-level image data.

That is, when the pixel value of each pixel of the multi-level image data acquired by the image data acquiring unit 10 is a pixel value (density value) of each of 'C', 'M', 'Y', and 'K', as described above, and each pixel value is represented by 8 bits 256 gray-scale levels. When this is four-value-ized as gray-scale level: N=4, pixel values of the respective pixels are classified into four gray-scale values using three threshold values as shown in the dot-gray-scale level conversion table 300 of FIG. 5.

The right column of the dot-gray-scale level conversion table 300 of FIG. 5 illustrates relationship between the threshold values and the respective pixel values when the multi-level pixel values of 256 gray-scale levels are four-value-ized as gray-scale level: N=4.

That is, according to the dot-gray-scale level conversion table 300, three threshold values of '42 (first threshold value)', '126 (second threshold value)', '210 (third threshold value)' are used when the pixel values (density values) of the respective pixels of the multi-level image data are specified by 8 bits (0 to 255), N=1 (density '0', luminance '255') when the pixel value is 'not more than 42', N=2 (density '85', luminance '170') when the pixel value is '43 to 126', N=3 (density '170', luminance '85') when the pixel value is '127 to 210', and N=4 (density '255', luminance '0') when the pixel value is 'not less than 211'.

Accordingly, when the pixel value of each pixel of the multi-level image data acquired by the image data acquiring unit 10 is a pixel value (density value) of each of 'C', 'M', 'Y', and 'K' as described above, the three threshold values are used per pixel value to generate four-level image data.

The printing control data generation unit 18 sets a dot corresponding to the N-level data by the image data N-level quantization unit 16 per pixel to generate data for printing capable of being used by the printing unit 20 of the ink jet type.

The left column of the dot-gray-scale level conversion table 300 of FIG. 5 illustrates relationship between pixel values of the respective pixels of the N-level data from the printing control data generation unit 18, and the corresponding dot sizes.

Referring to FIG. 5, when four values of 'gray-scale value: 4' are used to select 'density value' as a pixel value, the dot size of the 'gray-scale value: 1' is converted to 'no dots' (the dots are not printed), the dot size of the 'gray-scale value: 2' is converted to 'small dot' having a smallest dot area, the dot size of the 'gray-scale value: 3' is converted to 'medium dot' having a medium dot area, and the dot size of the 'gray-scale value: 4' is converted to 'large dot' having the largest dot area.

Accordingly, when the pixel value of each pixel of the N-level data acquired by the image data N-level quantization unit 16 corresponds to each of 'C', 'M', 'Y', and 'K' as described above, printing control data converted to any one of 'no dots', 'small dot', 'medium dot', and 'large dot' are generated per color.

Meanwhile, when the 'density value' is used as the pixel value, dots are converted in the opposite manner as the 'density value'.

The printing unit 20 is configured as an ink jet printer, which prints the printing control data generated by the printing control data generation unit 18 using the printing head 200, and moves any one or both of a printing medium (paper) and the printing head 200 while ejecting ink from the nozzle modules 50, 52, 54, and 56 disposed in the printing head 200 in the respective dot shapes to form a predetermined image composed of several dots on the printing medium. Accordingly, in addition to the printing head 200 described above, the printing head 200 is composed of known components, such as a printing head conveyance unit (not shown) of causing the printing head to reciprocate in a widthwise direction on the printing medium (in case of the multi-pass type), a paper feed unit (not shown) of moving the printing medium, a printing controller (not shown) of controlling the ink ejection of the printing head 200 according to the data for printing, and so forth.

The abnormal nozzle specifying unit 22 specifies an abnormal nozzle having a dot printing position deviation not less than a predetermined distance with respect to the printing direction among nozzles constituting each of the nozzle modules of the printing head 200.

To detail this, the printing head 200 can be used to print each test pattern per each nozzle module 50, 52, 54, and 56, to directly verify a printed matter of the test pattern, or read the printed matter of the test pattern by means of a scanner with a resolution at least higher than a resolution of the printing head 200 to verify how much the dot printing position is deviated from the defined printing position per nozzle, thereby capable of specifying the abnormal nozzle.

In this case, an actual deviation direction of the printing position typically occurs in 360° directions including an arrangement direction or inclined direction of the nozzles as well as the printing direction, and the printing deviation of the nozzle arrangement direction can be coped with the well known image processing technique, such that the printing deviation direction of the abnormal nozzle specified by the abnormal nozzle specifying unit 22 is verified based on the directions only before and after the printing direction.

Such specified abnormal nozzle information is stored in a storage device, such as a semiconductor memory (ROM) or the like, along with other information of the printing head 200, and can be read out whenever new image data are acquired.

Strictly speaking, all nozzles of the actual printing head 200 usually cause the dot printing position deviation in some degree, normal nozzles having the dot printing position deviation not more than a detection limit are rarely found. In addition, an amount of the printing position deviation may be changed according to the dot size. Accordingly, the abnormal nozzle specifying unit 22 prepares a predetermined threshold value for the amount of the printing position deviation, and specifies the only nozzle where the printing position deviation exceeding the threshold value has occurred as the abnormal nozzle.

The density correction unit 24 corrects an average density (or an average luminance) of the dot printing line printed by the abnormal nozzle specified by the abnormal nozzle specifying unit 22. Detailed methods of correcting the density will be described later, briefly, three methods including A. a method of correcting a dot printing pitch of the printing head 200 of the printing unit 20, B. a method of correcting a dot size of the printing control data generated by the print control data generation unit 18, and C. a method of correcting a pixel value detected by the pixel value detection unit 14 before making the pixel value N-level by the image data N-level quantization unit 16, are used to correct the average density of the dot printing line printed by the abnormal nozzle to be equal to an average density of the dot printing line printed by the normal nozzle near the abnormal nozzle with reference to the correction table 26 or the like as shown in FIG. 1.

Figure 2:
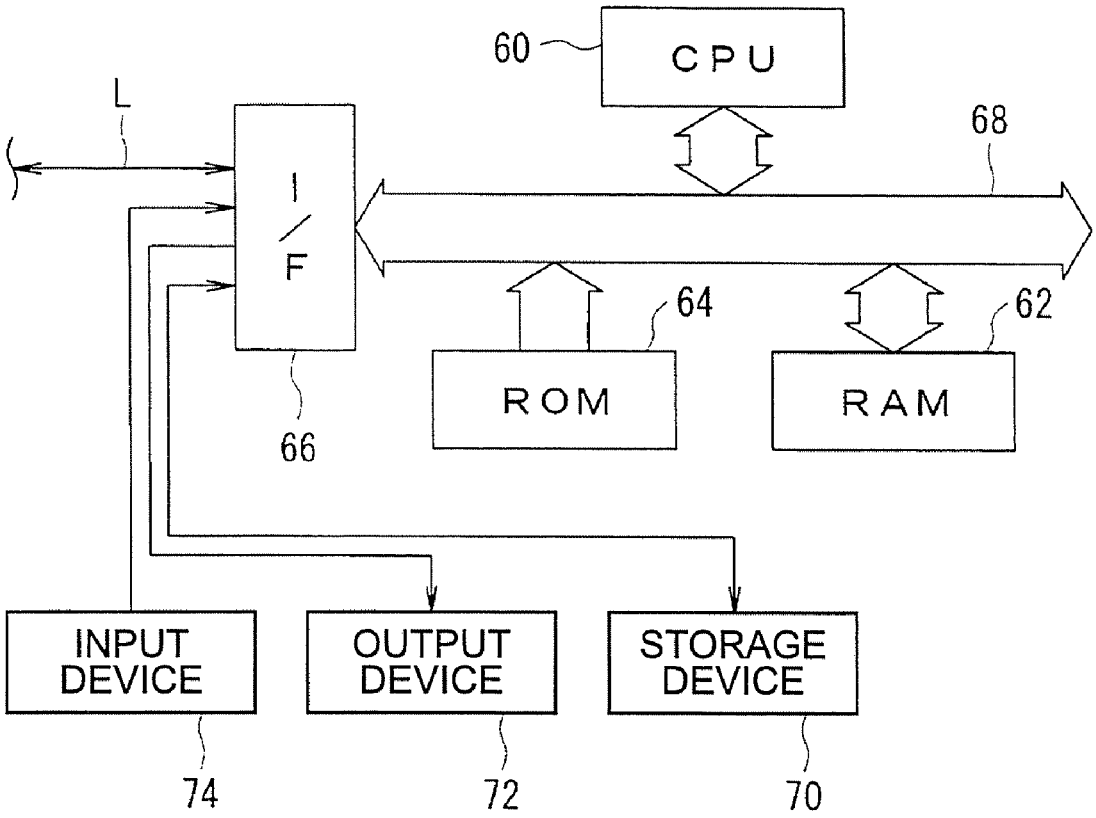
FIG. 2 is a block diagram of a hardware structure of a computer system for implementing a printing apparatus according to an embodiment of the invention.

In this case, the printing apparatus 100 has a computer system for implementing, on a software, the various control for printing, or image data acquiring unit 10, the printing deviation pixel specifying unit 12, the pixel value detection unit 14, the image data N-level quantization unit 16, the printing control data generation unit 18, the printing unit 20, the abnormal nozzle specifying unit 22, the density correction unit 24, or the like, and its hardware structure is such that a Central Processing Unit (CPU) 60 for various controls or operation, and a Random Access Memory (PAM) 62 and a Read Only Memory (ROM) 64 constituting the main Storage are connected by various internal and external buses 68 composed of Peripheral Component Interconnect (PCI) bus or Industrial Standard Architecture (ISA) bus while a secondary Storage 70, such as a Hard Disk Drive, an output device 72, such as a CRT, an LCD monitor or the printing unit 20, an input device 74, such as a control panel, a mouse, a keyboard, or a scanner, and an network (L) for communication with a printing indicating device (not shown) are connected to the bus 68 via an input and output (I/F) interface 66 as shown in FIG. 2.

When power is supplied, a system program, such as BIOS stored in the ROM 64, makes various dedicated computer programs which are stored in the RAM 64 in advance or various dedicated computer programs installed in the storage 70 loaded to the RAM 62 in the same manner via a storage medium, such as a CD-ROM, a DVD-ROM, or a flexible disk (FD), or via a communication network (L), such as Internet, and the CPU 60 uses various resources according to the instructions described in the programs loaded into the RAM 62 to process predetermined control and operation, such that functions of the respective units as described above can be implemented on the software.

Figure 8:
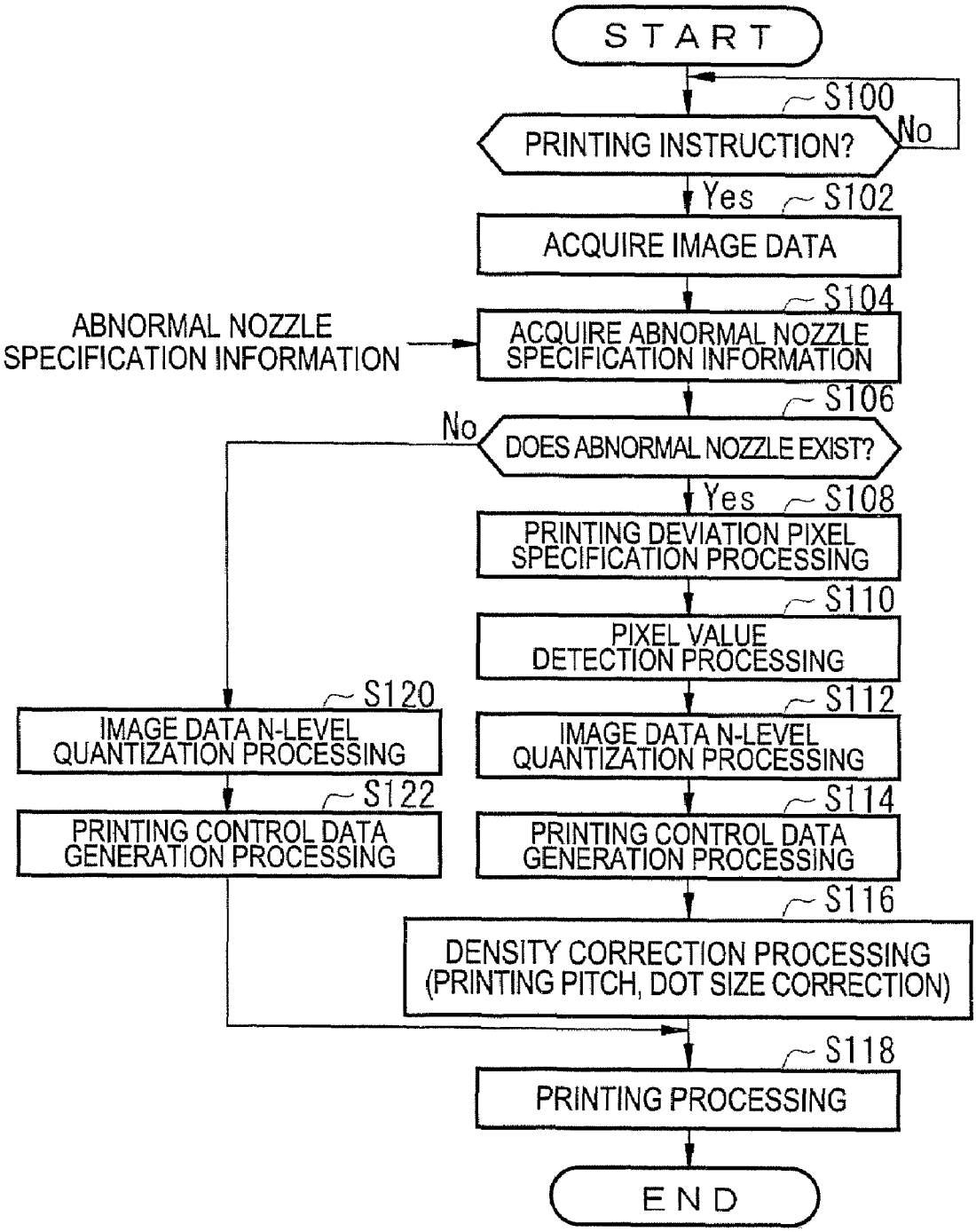
FIG. 8 is a flowchart illustrating an entire flow of printing processing according to a first embodiment.

Next, an example of the printing processing flow using the printing apparatus 100 having the above-described structure will be described with reference to the flowchart of FIG. 8.

When a predetermined initial operation for a printing processing is terminated after power is supplied, the printing apparatus 100 proceeds to Step S100 to monitor whether an explicit printing instruction from a printing indicating terminal is present when the printing indicating terminal (not shown), such as a PC, is connected, and reads (acquires) image data when the printing instruction and the multi-level image data to be processed are sent, and simultaneously has the color image data subjected to color conversion of 'C', 'M', 'Y', and 'K' (in a case of four colors) so as to correspond the color image data to the respective ink colors of the printing head 200 when the image data are the color image data composed of three primary colors of 'R', 'G', and 'B'.

Next, the process progresses to Step S104 to acquire abnormal nozzle specification information related to the printing head 200 provided from the abnormal nozzle specifying unit 22, and progresses to Step S106 for judgment to specify nozzles having the printing deviation position exceeding a predetermined distance (threshold value) before and after the printing direction among all available nozzles constituting the printing head 200 based on the acquired abnormal nozzle specification information.

As a result, when it is determined that there are no abnormal nozzles having printing deviation positions exceeding the threshold value (No), the process progresses to Step S120 to perform a normal printing processing (an image data N-level quantization processing (Step S120)) and a printing control data generation processing (Step S122), and when it is determined that there are abnormal nozzles (Yes) at Step S106 for judgment, the process progresses to Step S108 to specify all pixels corresponding to the abnormal pixels among pixels constituting the acquired multi-level image data, that is, all pixels where the dot printing is to be performed in the abnormal nozzles.

When all pixels where the dot printing is to be performed in the abnormal nozzles are specified, the process progresses to Step S110 to detect pixel values related to all pixels including the pixels, and then progresses to Step S112.

The image data are made to be N-level using some threshold values at Step S112 as described above to obtain N-level data, and the process progresses to Step S114 to generate printing control data allocating dots having a predetermined size per pixel based on the N-level data and then progresses to Step S116.

At Step S116, the density of the dot printing line where the dots corresponding to the pixels having the printing deviation specified at Step S108 are printed is corrected, and a printing processing is performed at Step S118 using the printing control data that is subjected to a density correction processing at Step S116, and then the process ends.

Hereinafter, the density correction processing of Step S116 will be described in detail, and general properties related to prerequisite description, an average density (luminance) of the dot printing line and the dot printing pitch will be described.

Figure 9A:
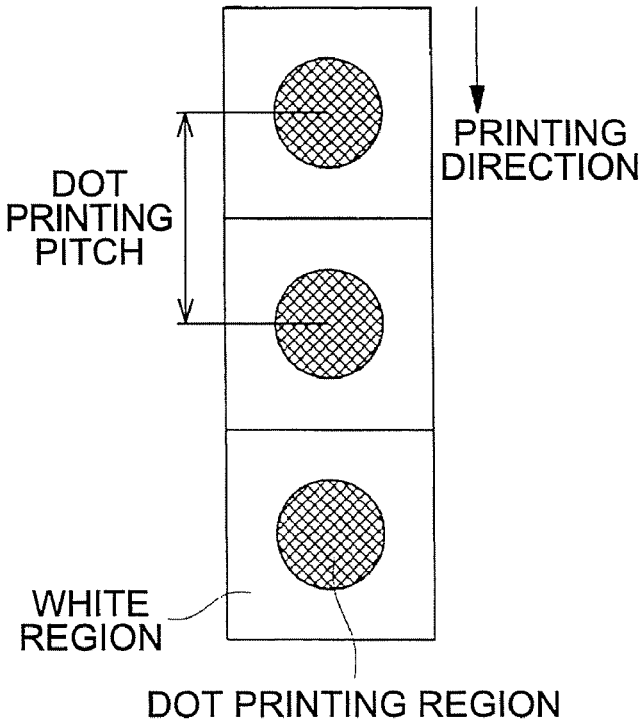
FIGS. 9A and 9B are conceptual views illustrating an example of a normal dot printing pattern and an abnormal dot printing pattern where dot deviation has occurred.

First, FIG. 9A is a schematic view illustrating two kinds (two colors) of dots, for example, cyan dot and magenta dot, having the same size which completely overlap each other with respect to the printing position are printed by two kinds of nozzles in the printing direction by a constant dot pitch, and all dots are printed in almost central position of the unit area of the white color background shown as a rectangular frame. Hereinafter, a state that such two kinds of dots almost completely overlap each other in the same position is assumed to be an ideal printing state.

Figure 9B:
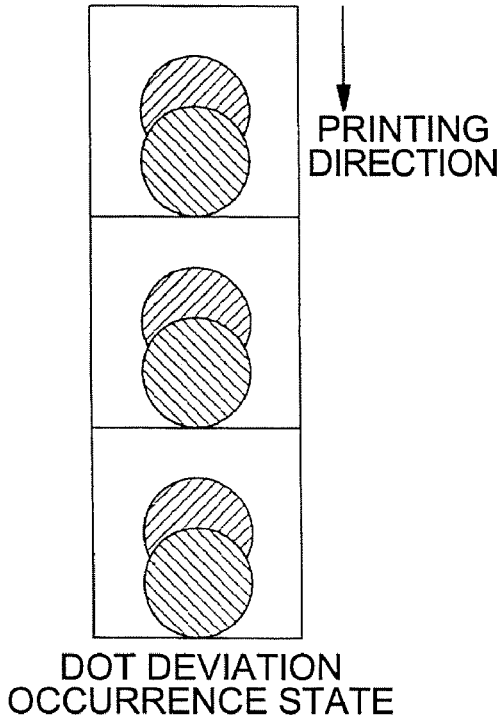

In contrast, FIG. 9B illustrates a state that one dot, for example, a cyan dot is printed in an ideal dot printing position while the other dot, for example, a magenta dot is printed by an abnormal nozzle having a printing position deviation to be deviated from the printing direction and printed.

Figure 10:
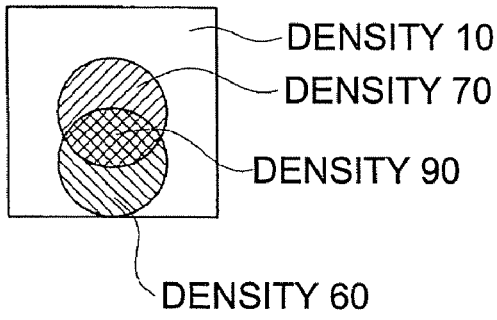
FIG. 10 is a conceptual view illustrating each density of a printing region.

FIG. 10 illustrates an example of densities of respective regions when one dot is deviated from its printing direction to have its partial portion overlapping another. That is, referring to FIG. 10, a density of the overlap dots is '90' when a density of the background color with no printing within a unit area shown as a rectangular frame is '10', a density of the dot printed in the normal and central position of the unit area is '70', and a density of the deviated dot is '60'.

As such, when the case of having dots of two colors printed and completely overlapping each other, a case of having the dots printed and partially overlapping each other, and a case of having the dots completely deviated and printed are compared, three overlapping primary colors may have the same reproducibility as each other in any cases, however, the color reproducibility becomes different in terms of printing. That is, color reproduction of the printing represents a complex behavior mixed with additive mixture of colors and subtractive mixture of colors, such that the density and color of the overlap portion are completely different from those of the non-overlap portion. Accordingly, even when the dots of the same color are printed, the result becomes completely different according to an overlap degree of the dots. Meanwhile, the result is changed even according to a printing paper as a printing target or a kind of ink.

However, when nozzles do not have respective printing positions and the nozzles have very irregular printing positions, the color change occurs on the nozzles due to the above-described reason, however, it is not visually problematic when the variation is small.

Accordingly, in the density correction processing according to the embodiment of the invention, an average density of the portion having a large variation to cause a visual problem is made to be corrected. Meanwhile, the variation should be corrected to be otherwise equal to the variation of normal range, however, in order to implement this, a look-up table (LUT) for color conversion from 'RGB' to 'CMYK' (when the ink have four colors of CMYK) per variation is required, such that it is impractical. That is, the LUT of the printer is generally large, such that it is impractical to prepare a plurality of LUTs per variation amount of each color.

Accordingly, when the density correction table 26 is prepared to match the density only, the density correction table only is required to be used, which thus allow processing to be very simple. In addition, human being is very sensitive to change in density but is not sensitive to change in color due to visual property of human being. Accordingly, the processing can be simplified while significantly reducing the banding phenomenon.

Figure 11A:
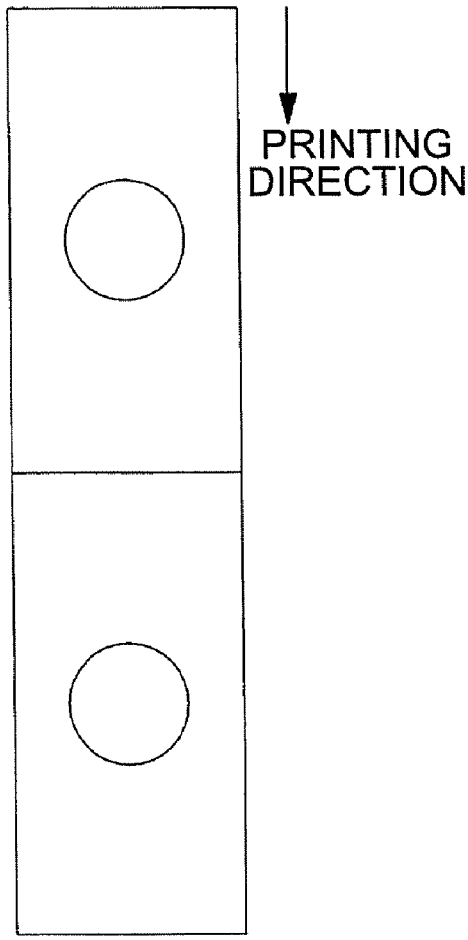
FIGS. 11A and 11B are conceptual views illustrating dot densities of a low density region and a high density region.

FIG. 11A schematically illustrates a low density (high luminance) region, which has a dot pitch with respect to the printing direction is longer than the case of FIGS. 9A and 9B such that a ratio occupied by the background region is larger than the dot region per unit area represented as a rectangular frame.

Figure 11B:
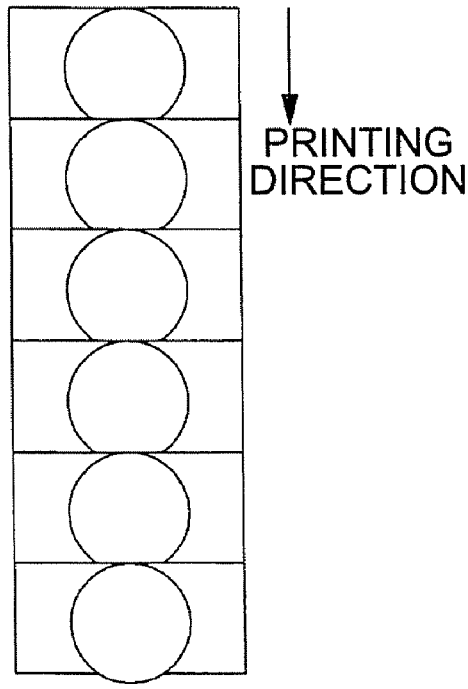

Meanwhile, FIG. 11B schematically illustrates a high density (low luminance) region, which has a dot pitch with respect to the printing direction is shorter than the case of FIGS. 9A and 9B such that a ratio occupied by the background region is smaller than the dot region per unit area represented as a rectangular frame.

Figure 12C:
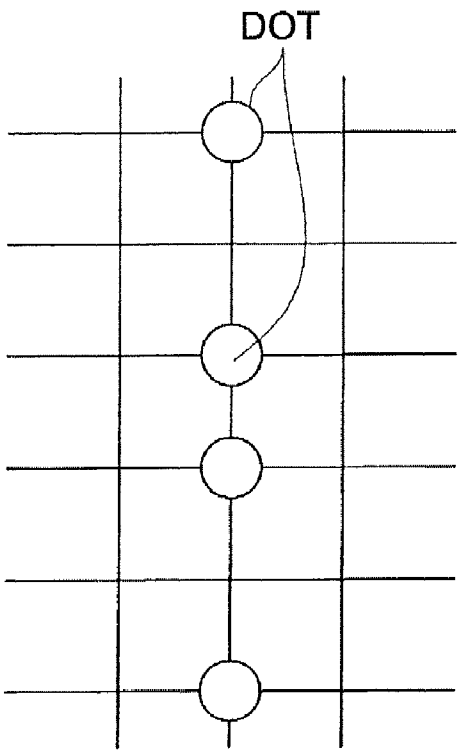
FIGS. 12A to 12C are explanatory views illustrating positions of possible dot printing in an actual printing head.
Figure 12B:
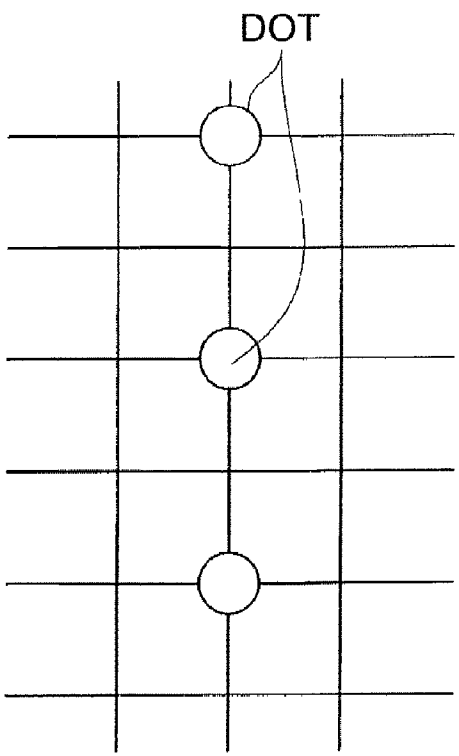
Figure 12A:
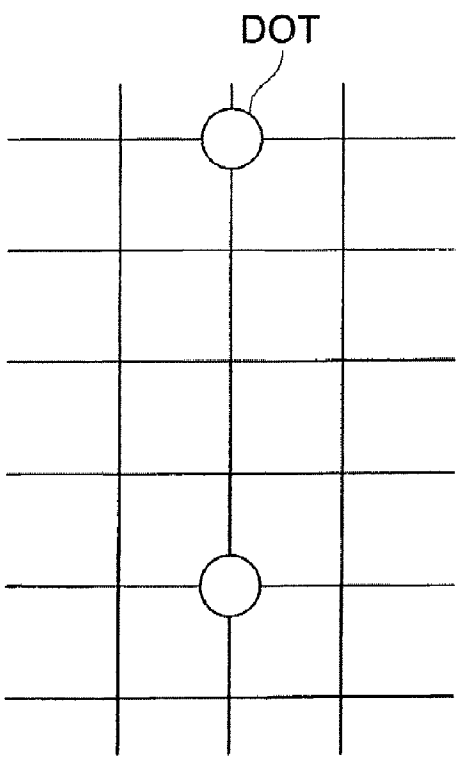

FIGS. 12A to 12C illustrate correction of dot pitches which are varied using the actual printing head. That is, in a case of the printing head of the ink jet printer, its dot pitch cannot be linearly corrected, and can only be printed on the lattice points of 720 dpi×720 dpi due to the resolution of the printing head and the resolution of the carriage for moving the printing head. FIG. 12A corresponds to a case of printing dots on every four lattice point of 720 dpi, FIG. 12B corresponds to a case of printing dots on every other lattice point, and FIG. 12C corresponds to a case where printing of dots on every other lattice point and a dot on the subsequent lattice point are repeated. As such, in the dot printed in the fixed position as shown in FIG. 12C, a plurality of dot pitches are combined to correct the average value to be a desired dot pitch.

Figure 13:
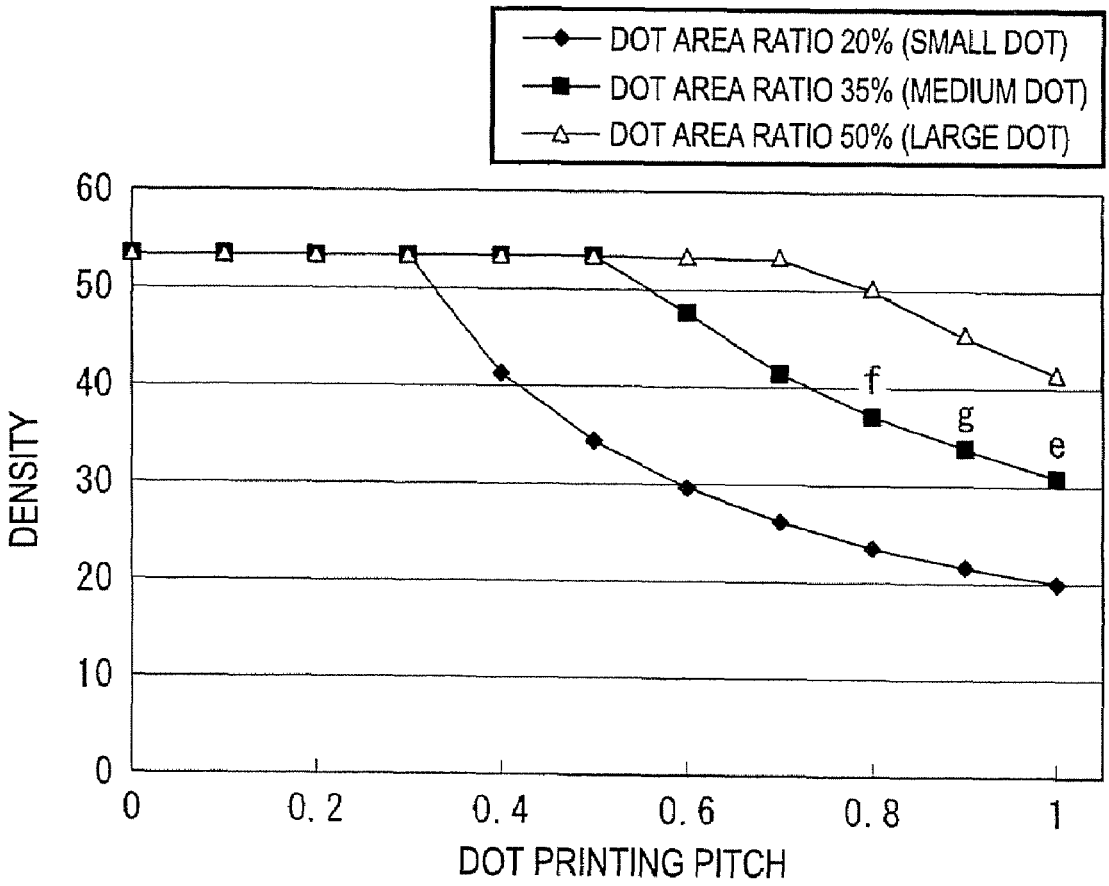
FIG. 13 is a graph illustrating relationship between a dot printing pitch and an average density.

FIG. 13 illustrates general relationship between a dot printing pitch and an average density per unit area of a dot printing line as shown in FIG. 9A. Meanwhile, the dot area ratio 50% indicates so called a large dot, the dot area ratio 35% indicates a medium dot, and the dot area ratio 20% indicates a small dot.

As shown in the drawing, when the dot printing pitch is '1', an average density of the small dot having the smallest dot area ratio is lowest, and an average density of the medium dot is higher than the case of small dot, and an average density of the large dot is highest.

The relationship continues even when the dot printing pitch is shorter, and each dot density is saturated after some extent such that the density difference between dots becomes almost insignificant. That is, in a case of the large dot having the largest dot area ratio, its average density increases when the dot printing pitch decreases, and then the background is covered by dots to be unseen, such that the density is saturated on the border of about '0.7' in the drawing, such that the density is not changed even when the dot printing pitch decreases. In addition, even in a case of the medium dot having a medium dot area ratio, its average density increases when the dot printing pitch decreases, and is saturated on the border of about '0.5', such that the density is not changed even when the dot printing pitch becomes smaller. In addition, even in a case of the small dot having the smallest dot area ratio, its average density increases when the dot printing pitch decreases, and is saturated on the border of about '0.3', such that the density is not changed even when the dot printing pitch becomes smaller.

Figure 14:
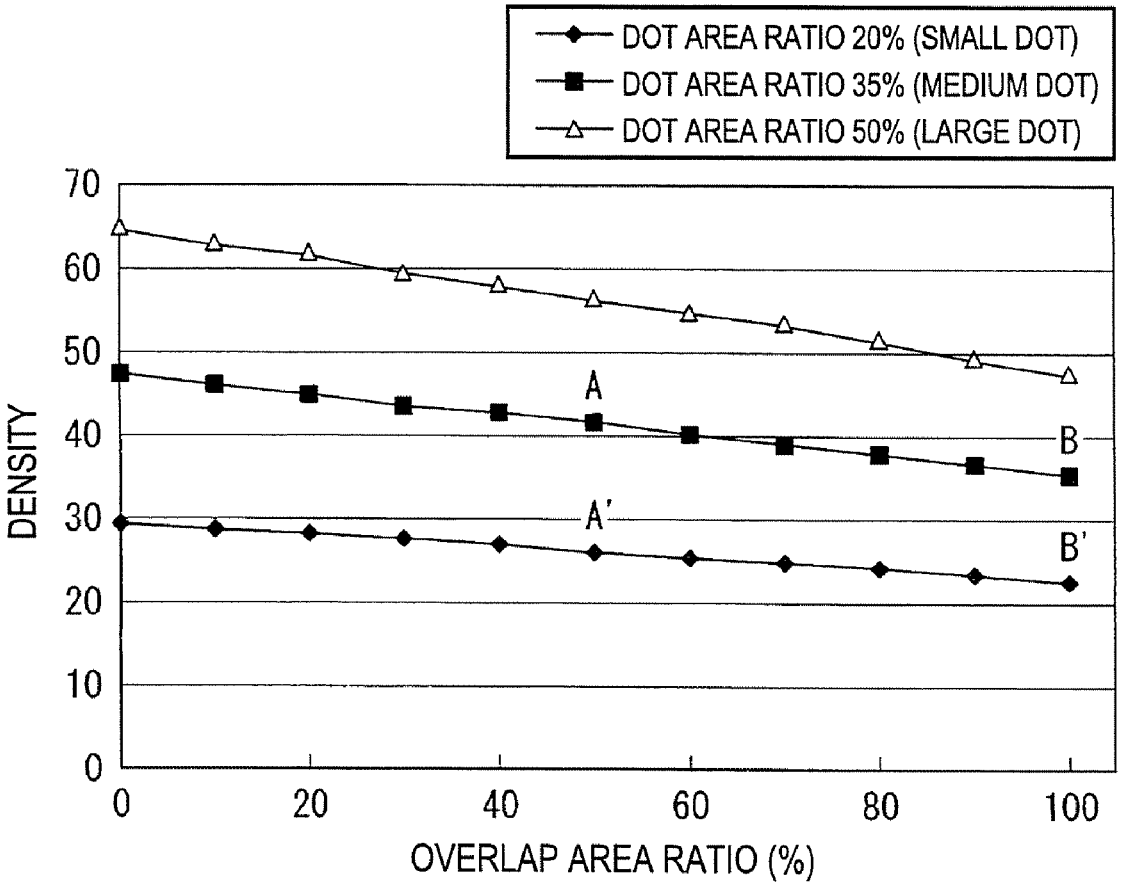
FIG. 14 is a graph illustrating relationship between a dot overlap area ratio and an average density.

FIG. 14 illustrates general relationship between an dot overlap ratio (%) and an average density per unit area of a dot printing line when two kinds (two colors) of dots having the same size overlap each other and are printed as shown in FIG. 10.

As shown in FIG. 14, it can be seen that the average density is the lowest when the overlap area ratio is maximum (100%), and the density per unit area increases when the overlap area ratio decreases, that is, an amount of printing deviation of two dots increase in any dots.

Figure 15:
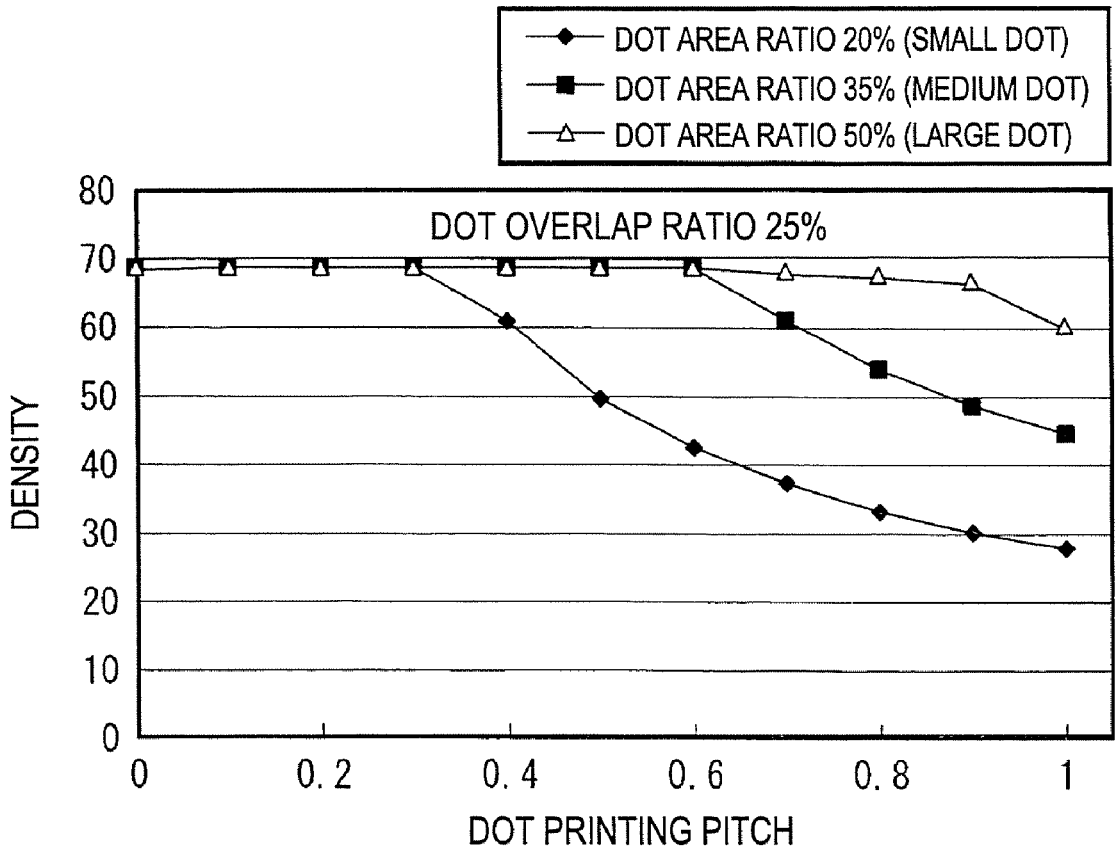
FIG. 15 is a graph illustrating relationship between a dot printing pitch and an average density at a dot overlap ratio of 25%.
Figure 16:
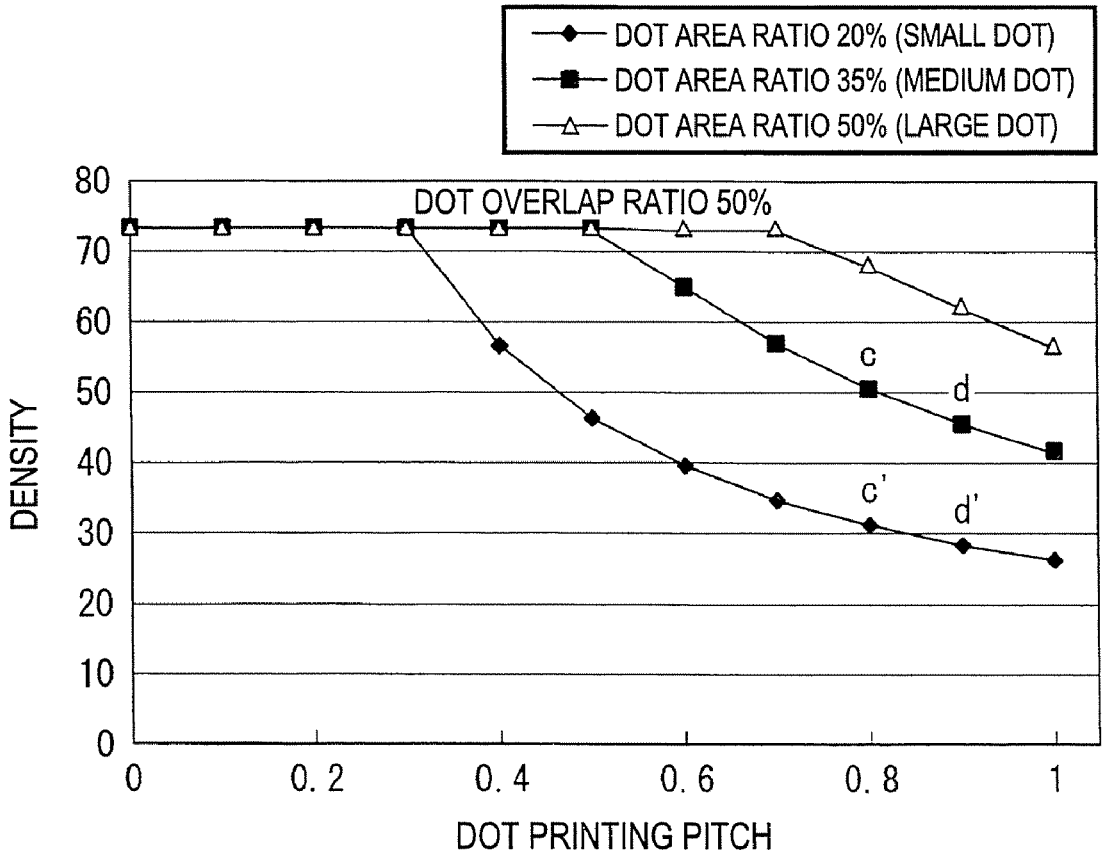
FIG. 16 is a graph illustrating relationship between a dot printing pitch and an average density at a dot overlap ratio of 50%.

FIGS. 15 and 16 illustrate general relationships between a dot printing pitch and an average density of the dot printing line of each of the dot overlap area ratios '25%' and '50%'.

As shown in the Figures, in any case of the dot overlap area ratios '25%' and '50%', like the one dot shown in FIG. 13, the printing pitch where the density is saturated is different, however, the average density increases when the dot printing pitch decreases in any cases, and is saturated at some pitch, and is not changed even when the dot printing pitch more decreases. Accordingly, when two kinds of dots where some of them overlap (are deviated and printed) each other are recognized as one dot, the same density change as the relationship between one kind of dots shown in FIG. 13 can be seen.

As can be seen from FIGS. 15 and 16, when the density change only is taken into account, it is not necessary to prepare a density correction table for all values, a density change value can be sufficiently calculated with some stored points only. In addition, it is necessary to have a density correction table per each color, and kinds of ink used for the typical ink jet printer are limited to four to eight, such that the kinds of dot combination to overlap each other are also a few. In addition, the same tendency is provided with respect to the density change, such that the correction can be sufficiently done on the extracted density change data.

The density correction processing of Step S116 of FIG. 8 will now be described in detail.

Figure 17:
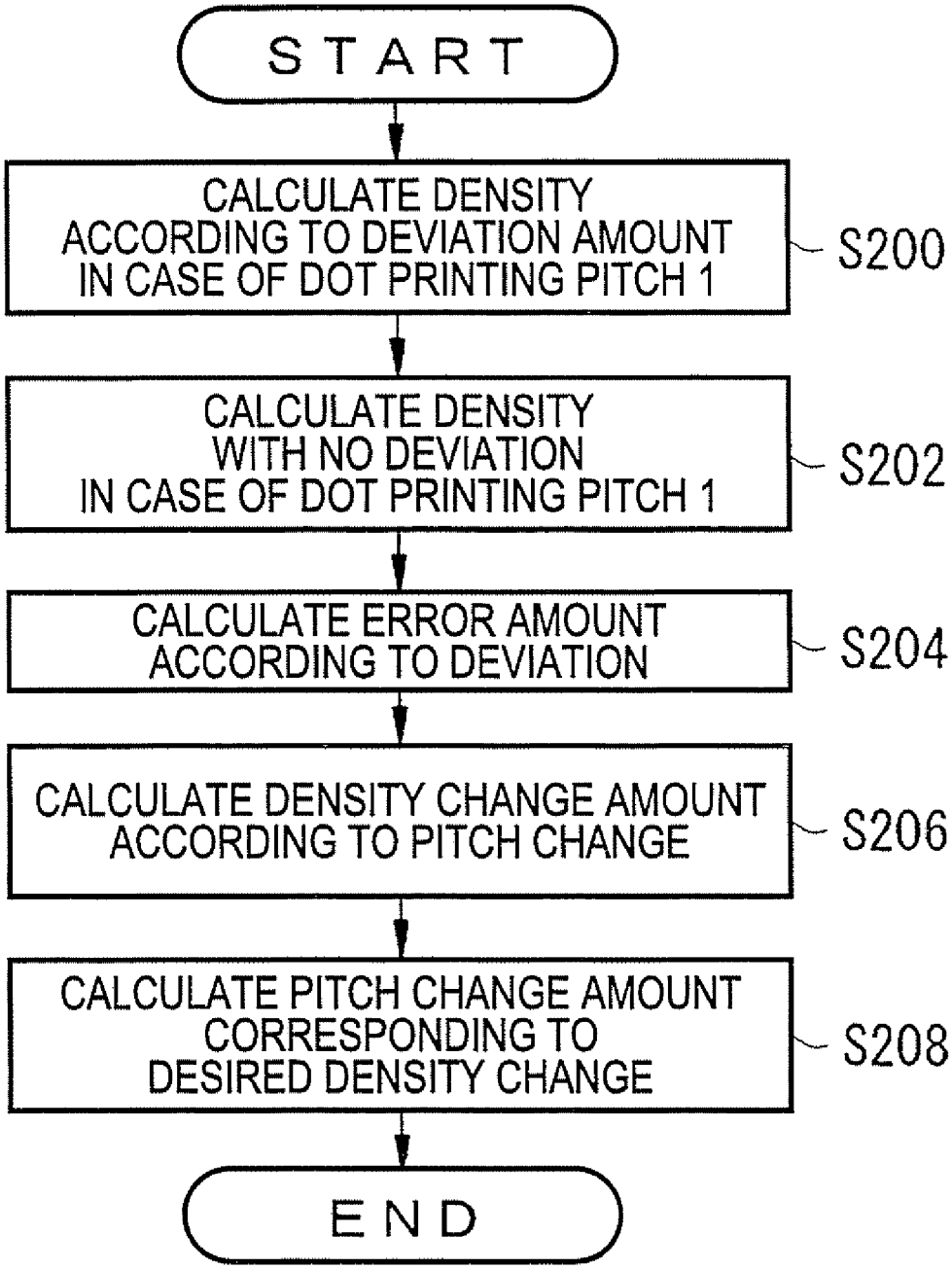
FIG. 17 is a flowchart illustrating an example of density correction processing.
Figure 18:
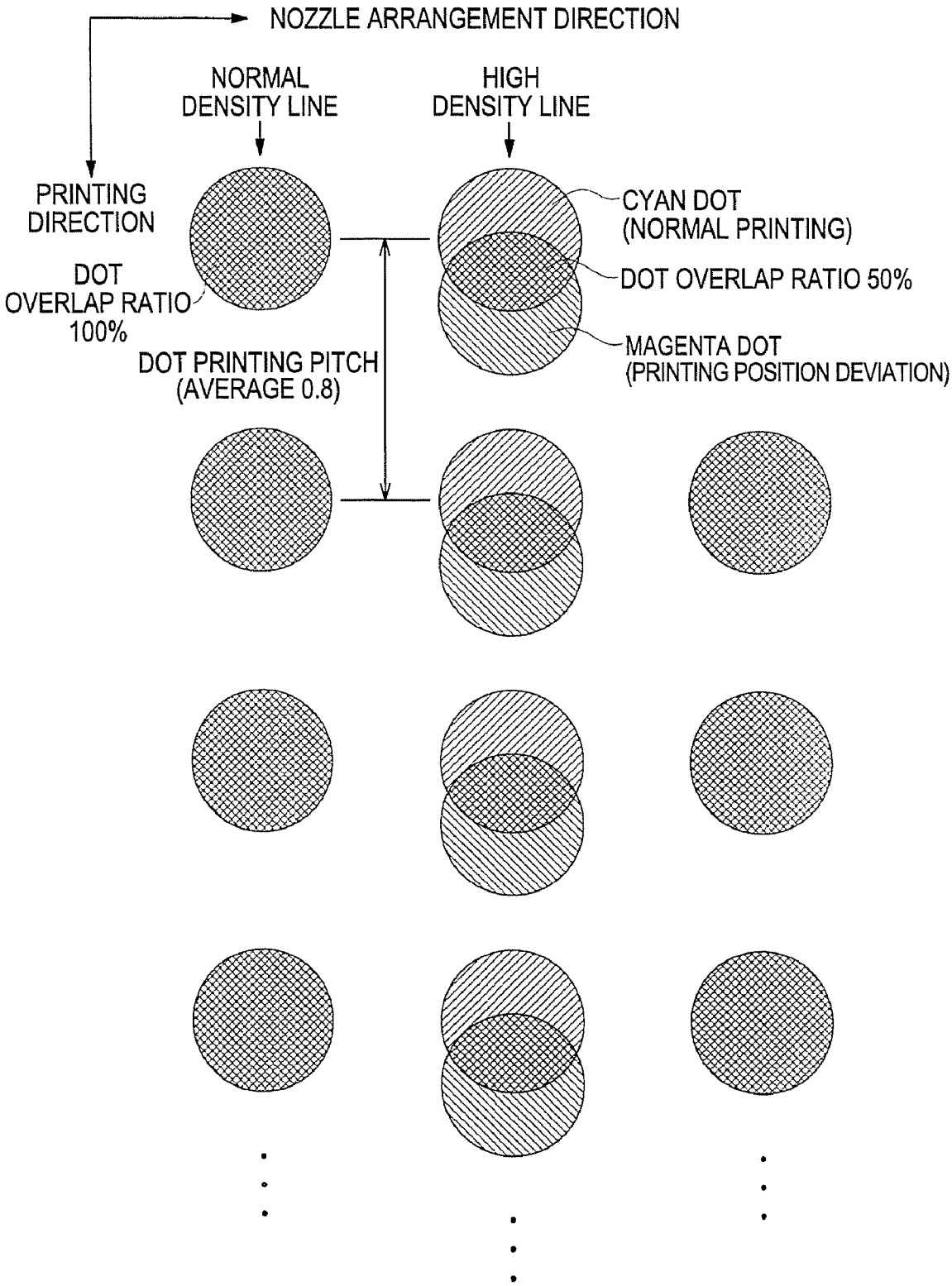
FIG. 18 is an explanatory view illustrating dot printing position relationship according to the first embodiment.

FIG. 17 is a flowchart illustrating an example of the density correction processing, and FIG. 18 illustrates the state that some of magenta dots cause printing deviation in a printing direction when two kinds of medium dots (dot area ratio 35%) composed of cyan dots and magenta dots are printed with a dot overlap ratio of 100% and a dot printing pitch of '0.8 (average)'. Meanwhile, the printing deviation is shown in the figure such that the dot overlap ratio between the magenta dot (having printing position deviation) and the cyan dot (normal printing) is 50%.

First, the density correction processing calculates an average density at the dot printing pitch of '1.0' of the line (high density line) causing the dot printing deviation (dot overlap ratio 50%), as shown at Step S200 of FIG. 17. That is, an average density at the dot printing pitch of '1.0' of the line (high density line) causing the dot printing deviation (dot overlap ratio 50%) becomes '41.4' as shown in (A) of FIG. 14.

Then, the process progresses to Step S202 to calculate an average density at the dot printing pitch of '1.0' of the line (normal density line) with no dot printing deviation. That is, an average density at the dot printing pitch of '1.0' of the line (normal density line) with no dot printing deviation on one side becomes '35.4' as shown in (B) of FIG. 14.

Accordingly, the dot printing deviation occurs to cause the change by the two values, such that this changed density value can be corrected at Step S204. That is, as described above, when two dots overlap each other, the density of the overlap portion is enhanced, however, the density as the area grayscale level decreases because the resultant printing dot area decreases.

Accordingly, the density correction processing can be performed in consideration of this amount of reduced density, and the density (luminance) can be made to be almost equal to that of the normal density region.

To detail this, the graph of the dot overlap area ratio 50% and the dot printing pitch of '1.0' shown in FIG. 16 are used to calculate a movement amount of the dot printing pitch allowing correction of '41.4'−'35.4'='6.0' as a changed density value.

Then, the process progresses to Step S206 to calculate a density change value according to the pitch change. That is, an amount of changed density when the dot printing pitch of '0.8' (in the drawing, 'c') is changed to the dot printing pitch of '0.9' with reference to FIG. 16, becomes '50.2'−'45.3'='4.9'.

Figure 19:
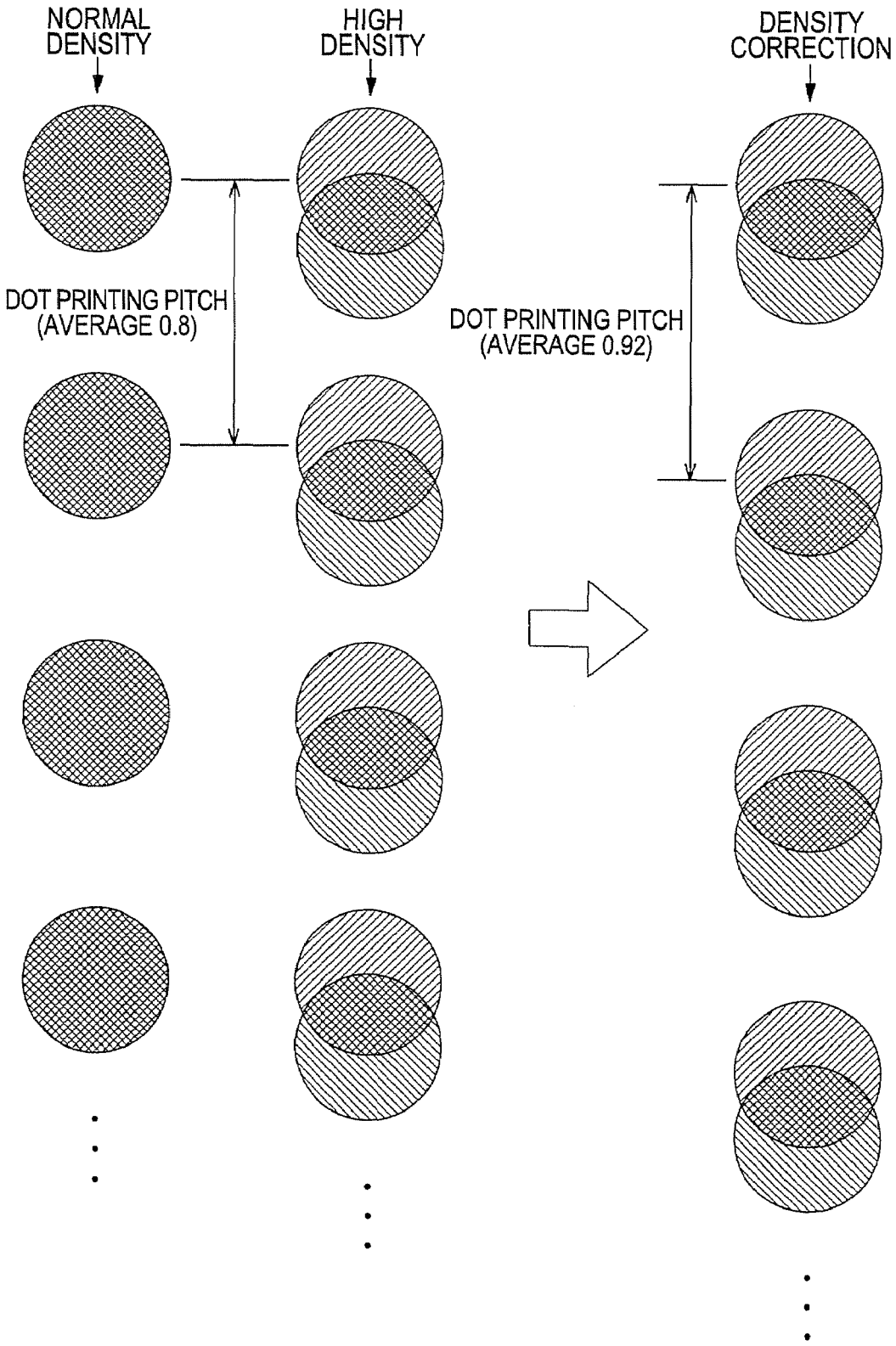
FIG. 19 is an explanatory view illustrating a density correction processing according to the first embodiment.

As shown in FIG. 19 from these information, only a distance of '6'/'4.9'×('0.9'−'0.8')='0.12' is changed with respect to the pitch of '0.8' by means of linear correction, such that the printing with a pitch of '0.8' can be changed to the printing with a pitch of '0.8'+'0.12'='0.92'.

As such, the dot printing pitch of the line where the printing deviation occurs can be corrected to match the normal dot printing line and its density (luminance), such that the banding phenomenon due to the density (luminance) change can be removed or made to be almost unnoticeable.

The position where the dots can be actually printed is fixed to a position on any lattice point (in case of printing resolution of 720 dpi, lattice point formed with a pitch of 720 dpi) as described above, the printing onto the calculated position may not be possible according to the printing resolution of the printing head 200. Accordingly, when an arbitrary area is noticed in terms of the image implemented using area gray-scale level in the above-described example, its average dot printing pitch is changed to a calculated position. That is, a dot printing pitch of FIG. 12B becomes half the dot printing pitch of FIG. 12A. In addition, a case of having the interval between dots in half is repeated in FIG. 12C, such that an interval between dots is represented as an addition of ½ and ¼, which thus results in a ⅜ dot interval of FIG. 12A.

Next, a second embodiment related to the density correction processing will be described.

The dot printing region in this embodiment is a medium density region except for the highlighted portion or the shadowed portion, and is assumed to have two kinds of dots, that is, a medium dot having a dot area ratio of 35% and a small dot having a dot area ratio of 20%, having different sizes from each other printed at the same ratio. In addition, the average dot printing pitch was '0.8' calculated from the printing density, and the dot overlap ratio was 50%.

In this case, the density value when the printing deviation has occurred while the dot printing pitch is '1.01' from FIG. 14, becomes '26.2+41.4'/2='33.8' as an average value of the values represented by 'A' and 'A''.

Meanwhile, the density value when the dot printing deviation does not occur (dot overlap ratio 100%) becomes '22.8+35.4'/2='29.1' as an average of values represented by 'B' and 'B'', and an occurrence of the dot printing deviation leads to an occurrence of the change in density value by the difference, such that the value of the changed density can be corrected.

To detail this, a graph of dot overlap area ratio of 50% shown in FIG. 16, and a dot printing pitch value of '1.0' are used to calculate the printing pitch allowing the change by '33.8'−'29.1'='4.7' to occur as a value of changed density, like the first embodiment.

An amount of changed density when the dot printing pitch of '0.8' is changed to the dot printing pitch of '0.9' with reference to FIG. 16, becomes '31.3−28.4'−'50.2−45.3')/2='3.9' in the same drawing ('c', 'd', 'c', and 'd').

From this information, a distance of '4.7/3.9'×'0.1'='0.12' can be changed with respect to a pitch of '0.8' by linear interpolation, and the pitch of '0.8' can be replaced by '0.8'+'0.12'='0.92' as shown in FIG. 19.

As such, even when printing deviation occurs on dots having different sizes, the dot printing pitch of the line where the printing deviation occurs can be corrected to make the average density (luminance) of the line match the normal dot printing line, like the first embodiment, such that the banding phenomenon due to the density (luminance) change can be removed or can be almost unnoticeable.

Next, a third embodiment related to this density correction processing will be described.

It has been described that two kinds of dots are always printed with the same printing pitch (dot density) in the first and second embodiments, however, the two kinds of dots are hardly printed with the same printing pitch. Accordingly, two kinds of dots can be printed in one region and one kind of dots only is printed in another region in this embodiment, such that the density correction processing when printing densities are different per printing region will be described.

When the dots need to be printed in the same position in a micro manner, the density values to be changed become equal. However, the density value of the image data before N-level conversion was changed to obtain a desired density in this embodiment, an average value with the density value printed as a single dot needs to be calculated as a density value to be changed.

In this embodiment, it is assumed that dots are mixed with a ratio of 1/3 and the same dot printing pitch as the first embodiment and other region has dots of '70' printed for simplicity of calculation. In addition, medium dots only are printed in this region.

In this case, the density value of the case that the single color dot is printed with a dot printing pitch of '1.0' and a density of '70', is '30.9' as shown in (e) of FIG. 13.

The density of the region where the deviation occurs with respect to the density difference of the region where two dots are mixed and printed from the first embodiment is '41.4' as shown in (A) of FIG. 14, and the density of the region with no deviation is '35.4' as shown in (B) of FIG. 14.

In this case, it is assumed that dots are mixed at a ratio of 1/3, such that a density value of a region of interest becomes '30.9+41.4×(1/3)'/'4/3'='33.5', and an ideal density value becomes '30.9+35.4×(1/3)'/'4/3'='32.0'.

Accordingly, the changed amount becomes '33.5'−'32.0'='1.5'.

When the value of changed density is calculated when the dot printing pitch is changed from '0.8' to '0.9', the value of the changed density in the single color becomes '37.1'−'33.6'='3.5', like the first and second embodiments, which subtracts (e) from (f) of FIG. 13.

The result when the dots overlap each other corresponds to '4.9' from the first embodiment.

When the dot printing pitch is changed from '0.8' to '0.9' in two dots are mixed from the dot mixing ratio, resulting in '3.5+4.9×(1/3)'/'4/3'='3.9'.

Accordingly, an amount of changed dot printing pitch for covering the amount of changed density '1.2', becomes '1.5'/'3.9'×'0.1'='0.04', such that the dot printing pitch may be changed to '0.8'+'0.03'='0.84'.

In this embodiment, an absolute density of the overlap dots decreases, such that the density of the portion represented by single dot is not changed. Meanwhile, since the density is corrected, the single dot for the density between dots is also adjusted. Accordingly, an amount of changed dot printing pitch is reduced compared to the first embodiment.

Next, a fourth embodiment related to this density correction processing will be described.

The density correction processing has been performed by adjusting (correcting) the dot printing pitch (dot density) with respect to N-level data in the first to third embodiments, however, in this embodiment, the pixel value (density) of the pixel of the multi-level image data corresponding to the dot having a printing deviation dot, that is, image data before N-level processing, such that the same advantages as the above embodiment can be obtained.

Figure 20:
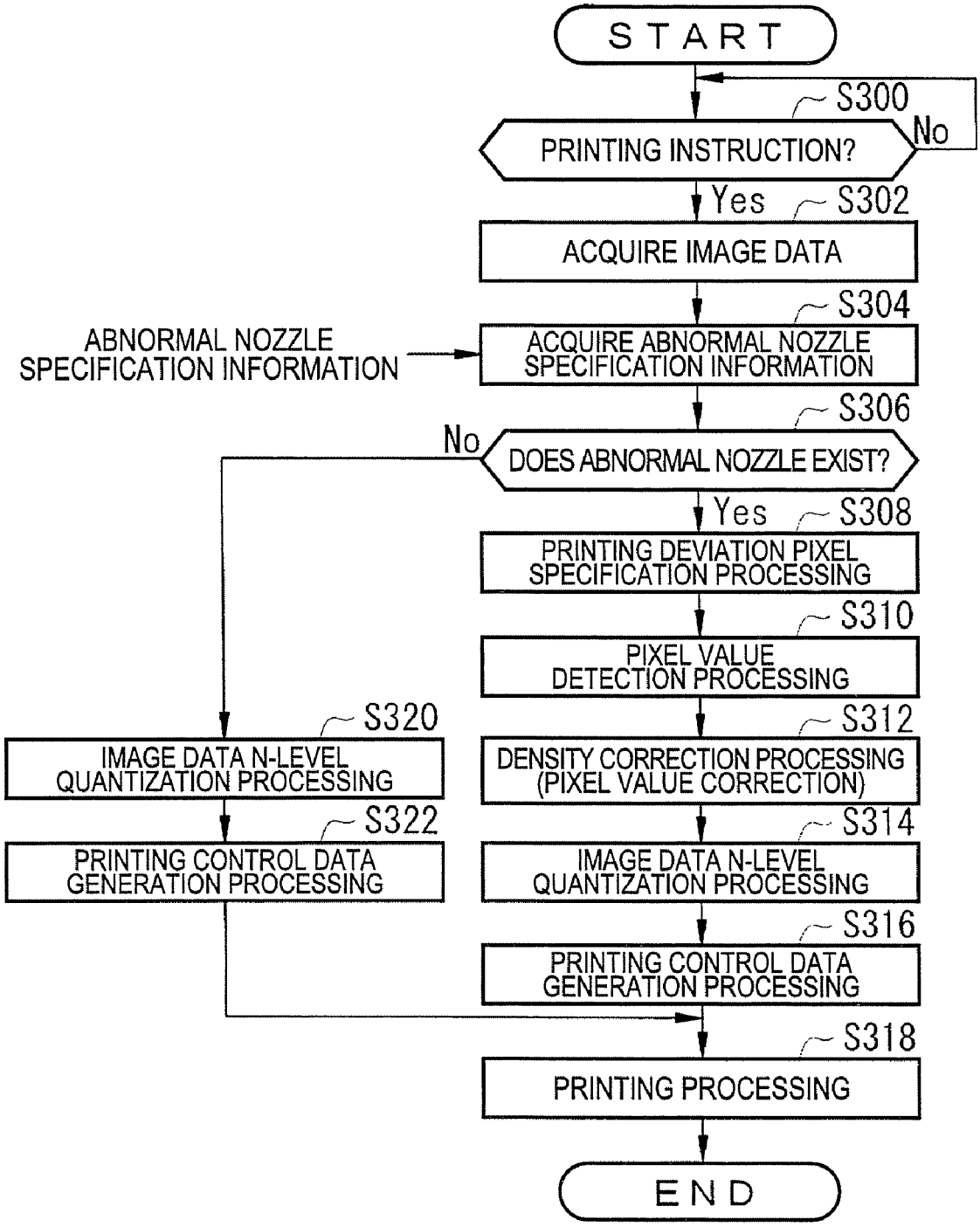
FIG. 20 is a flowchart illustrating an entire printing processing according to a third embodiment.

FIG. 20 is a flowchart illustrating entire printing processing according to this embodiment.

As shown in the FIG. 20, at Step S300, it is monitored whether an explicit printing instruction is present, and the process progresses to Step S302 to immediately read out and acquire the image data when the printing instruction and the multi-level image data to be processed are sent.

Then, the process progresses to Step S304 to acquire the abnormal nozzle specification information related to the printing head 200 provided from the abnormal nozzle specifying unit 22, and then progresses to Step S306 for judgment to specify a nozzle having a printing deviation position exceeding a predetermined distance (a threshold value) before and after the printing direction among all available nozzles constituting the printing head 200 based on the acquired abnormal nozzle specification information.

As a result, when it is determined that there is no abnormal nozzle (No), the process progresses to Step S320 to perform a normal printing processing (an image data N-level quantization processing (Step S320) and a printing control data generating processing (Step S322), and when it is determined that there is an abnormal nozzle (Yes) at Step S306 for judgment, the process progresses to Step S308 to specify all pixels where the dot printing is performed by the abnormal nozzle, that is, pixels corresponding to the abnormal nozzle among pixels constituting the image data, and detects the pixel value of the specified pixel having the printing deviation at Step S310, and progresses to Step S312 to correct the pixel value of the pixel having the printing deviation.

Figure 21:
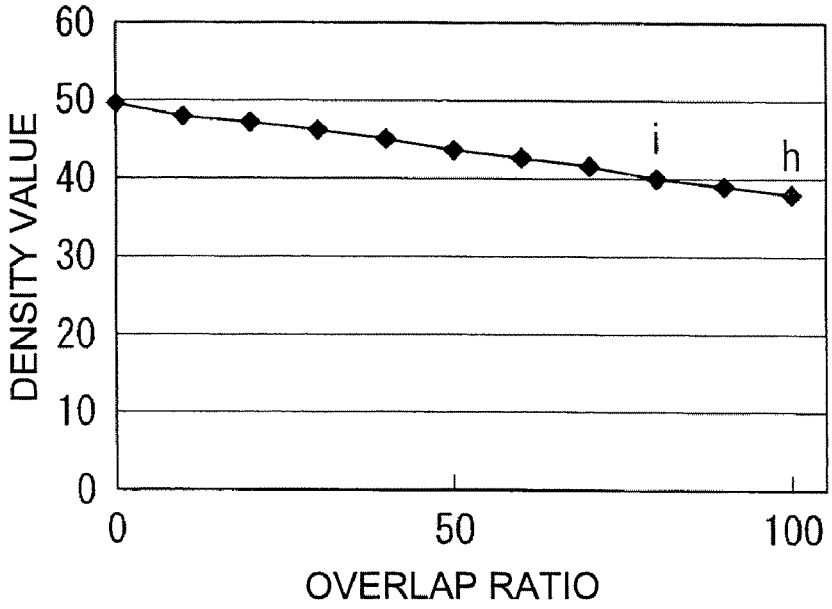
FIG. 21 is a graph illustrating an example of relationship between a dot overlap ratio and a density value.
Figure 22:
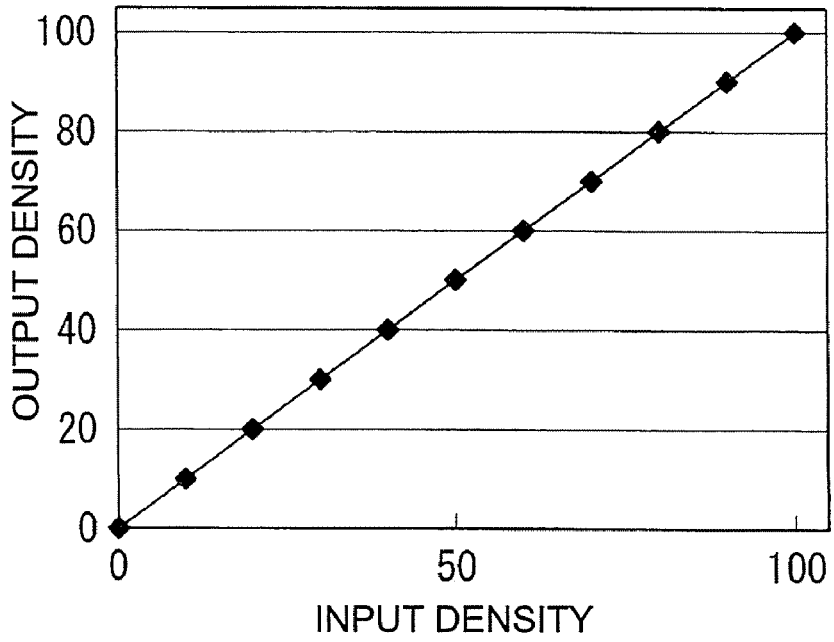
FIG. 22 is a graph illustrating an example of relationship between an input density and an output density.

For example, when dots of two kinds each having a density of '50' are printed at a dot printing ratio of 1:1, an amount of density change due to the printing deviation is changed as shown in FIG. 21, and an output density is output as a linear one with respect to the input density as shown in FIG. 22. In this case, when the change line having the overlap ratio of 80% was present in a specific line, the density value increases from '37.8' to '40.2' as shown in FIGS. 21H and 21I. To compensate the density, the density value of '37.8'+(37.8−40.2)='35.4' may be set for the line having the decreased density. In practice, the density should not be set by the decreased amount but be set to '35.4', however, the data by the decreased density can be set to almost compensate the density information.

Like the third embodiment, even when the dot ratio of two kinds is not 1:1, it is possible to predict an amount of reduced density from its mixed ratio to generate compensation data.

When the density correction processing ends is completed at Step S312, the process progresses to Step S314 to make N-level image data which is subjected to a pixel value correction processing to obtain N-level data, and printing control data allocating dots having a predetermined size per pixel are generated according to the N-level data at Step S316, and the printing processing is terminated using the printing control data at Step S118.

As such, the pixel value (density) of the pixel of the image data before N-level data Is corrected in this embodiment, such that the same advantages as the case of adjusting (correcting) the dot printing pitch (dot density), like the first to third embodiments.

As an embodiment of possibly having the same advantages in addition to the first to third embodiments, in addition to the first to fourth embodiments, or separately, the dot size corresponding to the pixel of the dot printing line where the density change occurs is made to be changed (generally to be smaller) with respect to the original dot size, such that the same advantages as the embodiments can be obtained. That is, an example of decreasing the density by changing the dot density (distance between dots) has bee described for decreasing the density, however, some dots may be made to be small to decrease the density. The dots may be adjusted for decreasing the density as an area gray-scale level.

The dot size divided by the known printing head 200 in the embodiments of the invention has four patterns including 'no dots', as shown in FIG. 5, however, the kinds of the dot size are not limited thereto, and at least one pattern other than 'no dots' is possible, and the more this patterns the preferable it is.

According to the embodiment of the invention, the existing printing head 200 and the printing unit 20 are hardly adjusted, only the dot printing pitch of the line where the dot printing deviation occurs is corrected, such that a dedicated printing head 200 or a dedicated printing unit 20 is not required, and the existing printing head 200 and the printing unit 20 (a printer) itself can be utilized.

Accordingly, when the printing apparatus 100 according to the embodiment of the invention is separated from the printing head 200 or the printing unit 20, its function can be implemented by a printing control device only having a general purpose computer system, such as a PC, and a computer program describing its control.

The printing apparatus 100 according to the embodiment of the invention can be applied to not only a line head ink jet printer but also a multi-pass ink jet printer (a serial printer).

Figure 23A:
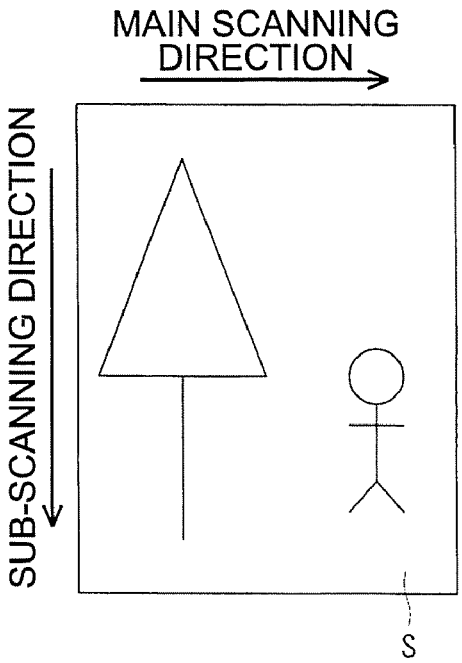
FIGS. 23A to 23C are explanatory views illustrating a printing difference between a multi-pass ink jet printer (a serial printer) and a line head ink jet printer.
Figure 23B:
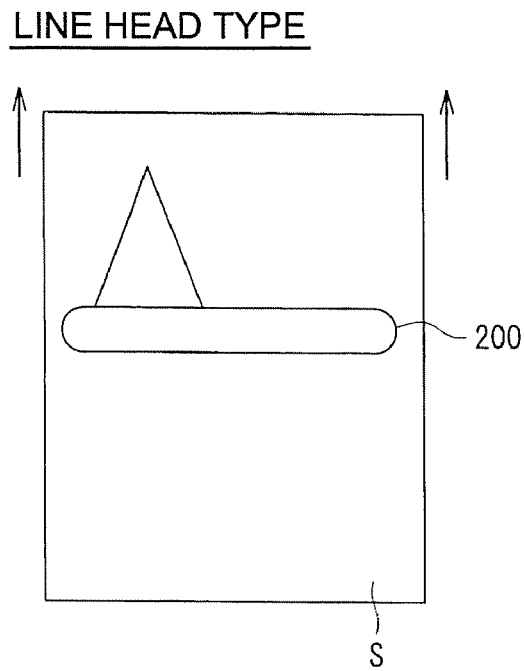
Figure 23C:
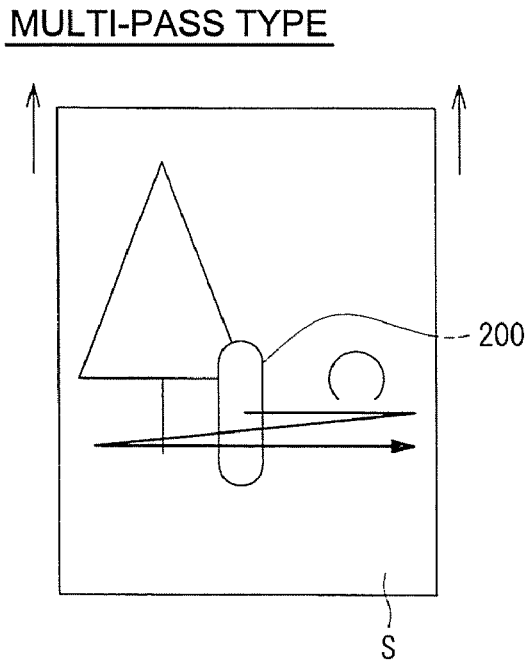

FIGS. 23A to 23C illustrate printing manners of the respective line head ink jet printer and the multi-pass ink jet printer.

As shown in FIG. 23A, when the widthwise direction of the printing paper S having a rectangular shape is a main scanning direction of image data and the longitudinal direction is a sub scanning direction thereof, the printing head 200 have a length corresponding to the paper width of the printing paper S as shown in FIG. 23B in the line head ink jet printer, and the printing head 200 is fixed and the printing paper S is moved in a sub scanning direction with respect to the printing head 200 to complete printing by one scanning (pass). Meanwhile, it is possible to fix the printing paper S using the flatbed scanner and move the printing head 200 in its sub scanning direction, or both can move in an opposite direction as each other while carrying out printing. In addition, the multi-pass ink jet printer caries out printing by locating the very short printing head 200 in a direction orthogonal to the main scanning direction compared to the paper width and causing the printing head to reciprocate several times in the main scanning direction while moving the printing paper S in the sub scanning direction by a predetermined pitch as shown in FIG. 23C. Accordingly, the latter multi-pass ink jet printer takes much time for printing than the former line head ink jet printer, however, can significantly reduce correction of the input density value because the number of nozzles to be corrected is significantly reduced.

An ink jet printer of ejecting ink in a dot shape to carry out printing has been described in this embodiment, however, the invention can be applied to other printing apparatuses using a printing head such that printing tools are arranged in parallel in a line shape, for example, a thermal head printer referred to as a thermal transfer printer or a thermal printer.

Figure 24:
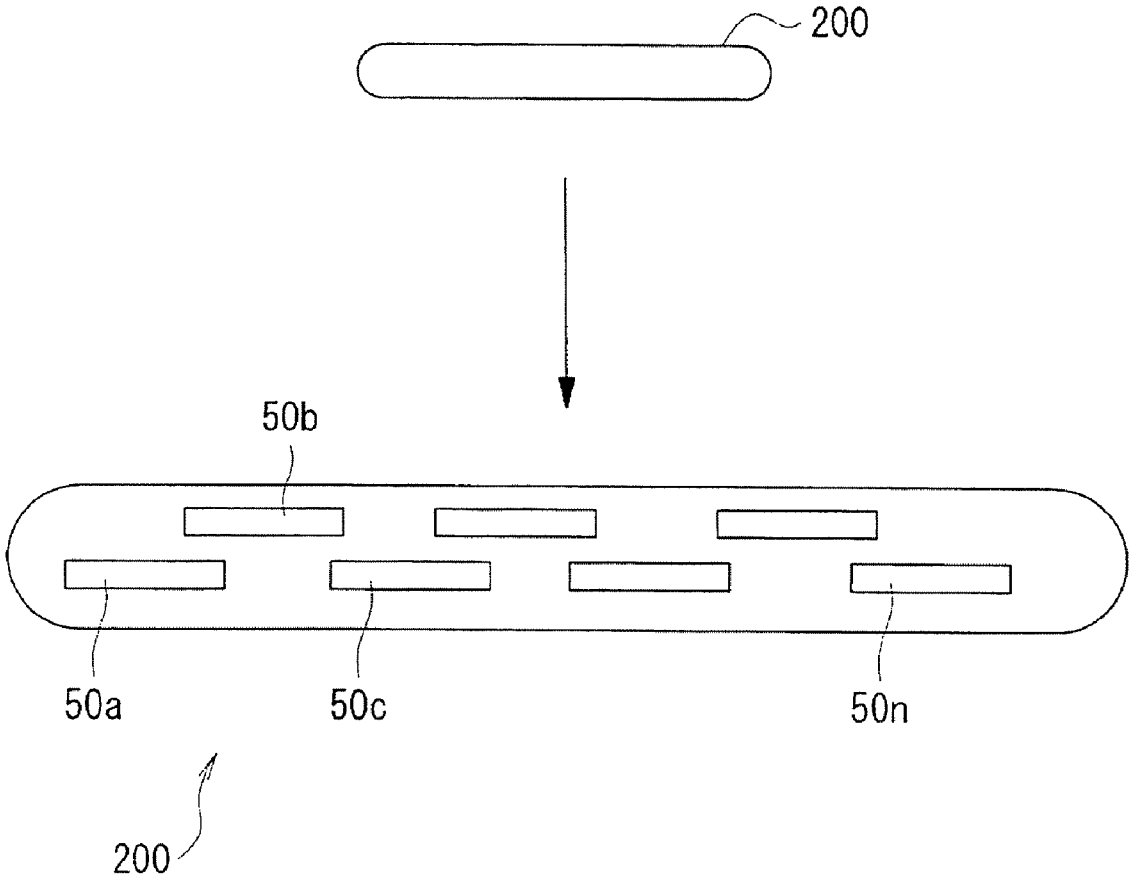
FIG. 24 is a conceptual view illustrating another example of a printing head structure.

Each of the nozzle module 50, 52, 54, and 56 prepared per each color of the printing head 200 has nozzles N arranged in a line in a longitudinal direction of the printing head 200 in FIG. 3, however, the each of nozzle modules 50, 52, 54, and 56 may be replaced by a plurality of short ruler shaped nozzle units 50*a*, 50*b*, . . . , and 50*n*, which may be arranged before and after the movement direction of the printing head 200 as shown in FIG. 24. In particular, when a plurality of short ruler shaped nozzle units 50*a*, 50*b*, . . . , and 50*n* are arranged per each of the nozzle modules 50, 52, 54, and 56, yield is significantly enhanced compared to the case of using the long ruler shaped nozzle units.

Figure 25:
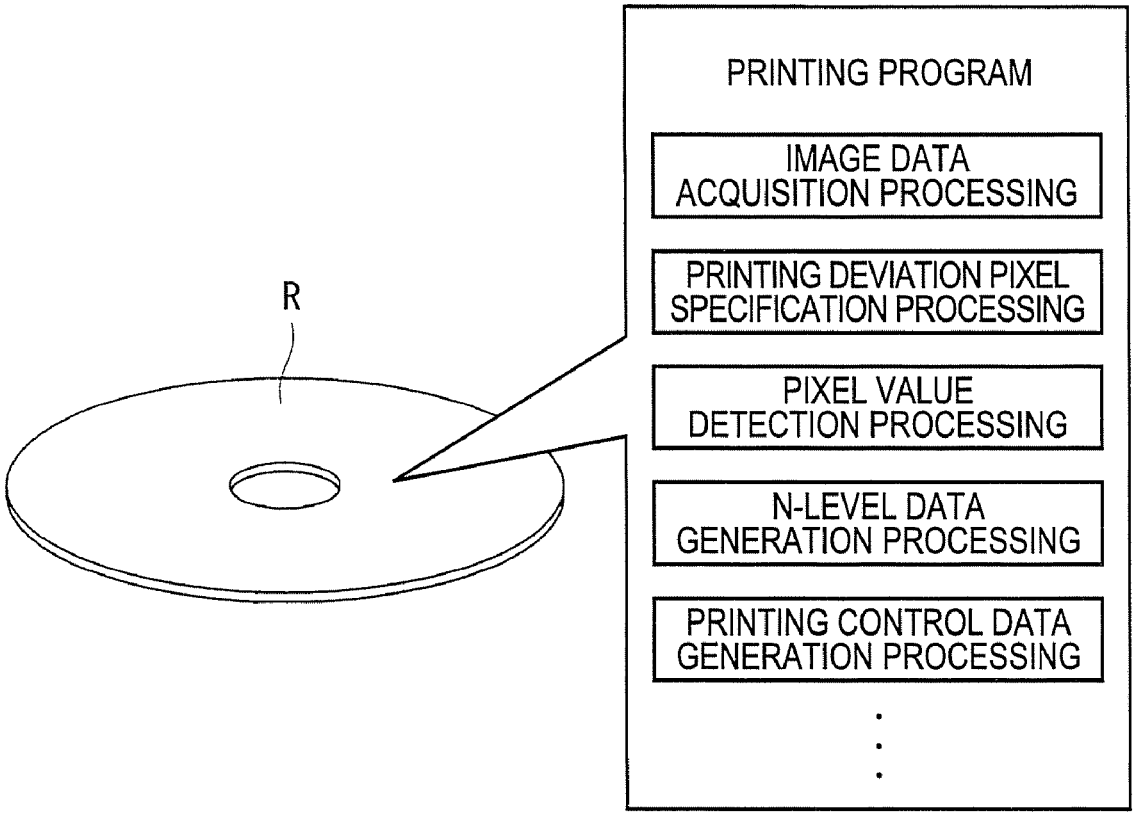
FIG. 25 is a conceptual view illustrating an example of a computer readable recording medium having recorded thereon the program according to an embodiment of the invention.
Figure 26:
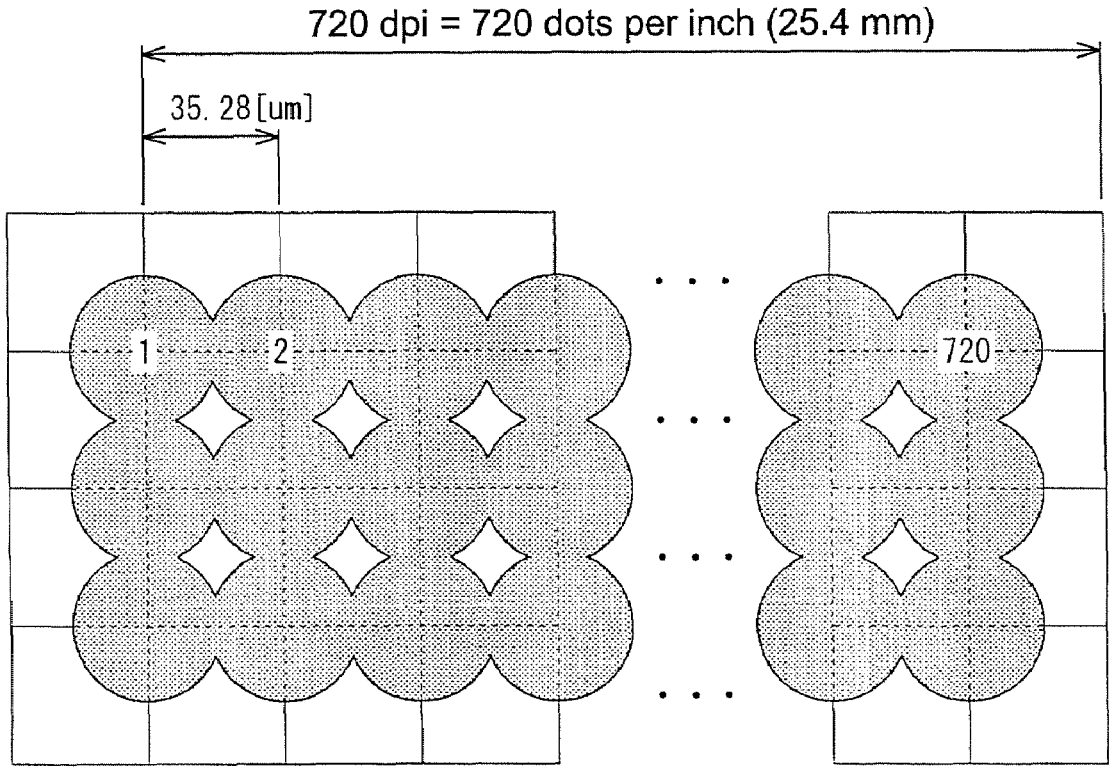
FIG. 26 is an explanatory view of ideal dot printing positions.

Each unit for implementing the above-described printing unit 100 can be implemented on a software using the computer system built in almost existing printing apparatuses, and the computer program can be built in a product while it is stored in a ROM in advance or interconnected via a network, such as Internet, and can be easily provided to desired users via a computer readable recording medium, such as a CD-ROM, a DVD-ROM, or a FD, as shown in FIG. 25.

According to the embodiments of the invention, a printing apparatus that can easily remove a banding phenomenon due to a deviation of printing position occurring particularly in a printing direction or making the phenomenon almost unnoticeable, a printing program, a printing method, a printing control device, a printing control program, a printing control method, and a recording medium having recorded thereon the program can be obtained.

What is claimed is:

1. A printing apparatus comprising:

a printing head having a plurality of nozzle modules corresponding to various ink colors;

an abnormal nozzle specifying unit that identifies an abnormal nozzle from amongst the plurality of nozzle modules, the abnormal nozzle specifying unit identifying the abnormal nozzle based on a position of a dot ejected by the abnormal nozzle and the degree to which the position of the dot deviates from a predetermined dot position; and a density correction unit that corrects a density of a dot printing line ejected by the abnormal nozzle based on information from the abnormal nozzle specifying unit, the density correction unit correcting a density of the dot printing line by adjusting a pitch of the dot printing line of the abnormal nozzle;

wherein the density correction unit corrects printing data corresponding to the dot printing line printed by the nozzles including the abnormal nozzle so as to be close to densities of other dot printing lines to be printed by only normal nozzles.

* * * * *